US009494318B2

(12) United States Patent
Meredith et al.

(10) Patent No.: US 9,494,318 B2
(45) Date of Patent: Nov. 15, 2016

(54) DEVICE FOR CLEANING AND REMOTELY INSPECTING A CHIMNEY

(71) Applicant: Merediths' Inc., Richmond, IN (US)

(72) Inventors: John E. Meredith, Richmond, IN (US); Thomas J. Urban, Fairfield, IA (US)

( * ) Notice: Subject to any disclaimer, the term of this patent is extended or adjusted under 35 U.S.C. 154(b) by 291 days.

(21) Appl. No.: 14/102,647

(22) Filed: Dec. 11, 2013

(65) Prior Publication Data

US 2014/0096330 A1 Apr. 10, 2014

Related U.S. Application Data

(63) Continuation-in-part of application No. 12/424,166, filed on Apr. 15, 2009, now abandoned.

(60) Provisional application No. 61/124,358, filed on Apr. 16, 2008.

(51) Int. Cl.
*F23J 3/02* (2006.01)

(52) U.S. Cl.
CPC ..... *F23J 3/026* (2013.01); *F23J 2213/60* (2013.01)

(58) Field of Classification Search
CPC ..... F23J 3/026; F23J 3/02; B08B 9/0436; B08B 1/00; B01F 7/00208
See application file for complete search history.

(56) References Cited

U.S. PATENT DOCUMENTS 1,293,777 A * 2/1919 Hogue ..... E21B 43/128 15/104.068
5,072,487 A * 12/1991 Walton ..... B08B 9/035 134/167 C
5,109,567 A * 5/1992 Harrison ..... B08B 5/04 15/345
5,472,514 A * 12/1995 Grimsley ..... B08B 1/04 134/21
5,584,093 A * 12/1996 Melendres ..... B08B 9/047 134/113
5,655,256 A * 8/1997 Hendrix ..... A46B 5/0095 15/395
5,813,089 A * 9/1998 Nolan ..... A46B 13/02 134/167 C
7,658,804 B1 2/2010 Cano
7,743,454 B2 6/2010 Favagrossa
2004/0231089 A1 11/2004 Alegre
2011/0138550 A1 * 6/2011 Park ..... A46B 5/0095 15/21.1

* cited by examiner

*Primary Examiner* — Robert Scruggs
(74) *Attorney, Agent, or Firm* — Woodard Emhardt Moriarty McNett & Henry LLP

(57) ABSTRACT

A device for cleaning a chimney preferably includes a rod assembly, cleaning arms, fan blades, a camera, and a stabilizing/positioning assembly. The cleaning arms are provided on an assembly that includes a rotatable hub with the cleaning arms extending from the hub. The fan blades may also extend from the hub or they may be provided separately. The camera is continuously rotatable around the longitudinal axis to allow an uninterrupted 360° scan of the chimney. The stabilizing/positioning assembly is effective to position the cleaning assembly hub a pre-selected stabilizing/positioning distance from an interior wall of a chimney while the hub rotates in the chimney. The cleaning and fan hub(s) is driven by a cable surrounded by a casing that allows the cable to rotate in the casing without rotating the casing. Controls allow the operator to control the speed and direction of the cleaning arms and the camera.

11 Claims, 29 Drawing Sheets

DEVICE FOR CLEANING AND REMOTELY INSPECTING A CHIMNEY

REFERENCE TO RELATED APPLICATIONS

This application is a continuation-in-part of U.S. patent application Ser. No. 12/424,166, filed Apr. 15, 2009, which claims the benefit of U.S. Provisional Patent Application Ser. No. 61/124,358, filed Apr. 16, 2008, which is hereby incorporated by reference.

FIELD OF THE INVENTION

The present invention relates generally to devices for cleaning a chimney, and more particularly to a device for cleaning a chimney flue, optionally while simultaneously scanning the interior of the flue.

BACKGROUND TO THE INVENTION

For many years chimney sweeps have cleaned chimneys using brushes that attach to a series of rods that extend the length of the brush. More recently, sweeps have attempted to use a motor, such as a power drill motor, to spin the rods to improve cleaning efficiency. Unfortunately, this design has not proven satisfactory since the design of known chimney cleaning brushes does not prevent the bristle ends from getting caught between gaps between flue tiles. This can cause injury to the operator if the spinning rods are suddenly stopped, which causes the drill to flip. Numerous sweeps have been injured operating these chimney cleaning devices.

It is also known to perform a video scan of a chimney flue to determine if there are defects in the flue liners. These defects may include cracked liners or mortar missing from between the 2 foot sections of clay flue liners. The scan may be performed by attaching a specially designed, lighted camera system to flexible 3-4 ft. rods. This is either lowered in from the top or pushed up from the bottom. Additional rods are added as the camera is lowered or pushed up into the chimney. These cameras have the ability to document defects as they are viewed on a monitor. In some cases the cameras have the ability to take photographs of any flue defects.

It is also known to control the dust caused by disturbing the soot and debris in a chimney. Most commonly, a large and cumbersome vacuum system is used. Alternatively, a squirrel cage type blower may be used to cover the flue opening on top of the flue to pull the dust out. Both methods are time consuming and cumbersome, and can be difficult to set up to properly ensure efficient dust removal.

As further background to the invention, it is known to use a brush attached to a flexible, rotating shaft (where a flexible shaft spins within a flexible outer casing) powered by an air driven or electric motor to clean residential and or commercial duct work. These duct systems exist primarily in horizontal configurations with short vertical duct shafts. The vertical portions of duct work for moving air are primarily less than 10 feet in length before terminating with an opening for delivering the air to the area intended. The primary purpose to clean ducts for moving air is to remove dust and other contaminates which may gather over time. These contaminates will primarily gather in the horizontal portions of the ducts while the short vertical ducts remain comparatively clean.

Flexible rotating shafts have been generally effective for cleaning duct systems because they are primary lowered downward through each opening of the short vertical portion of duct work. The shaft is then easily manipulated through the horizontal portion to the air plenum.

In the chimney setting though, the situation is somewhat different, and attempts to incorporate the "duct cleaning" technology to the chimney sweeping field have not been successful because the flexible shafts used by the duct cleaning art have not been effective for cleaning chimneys or long vertical ducts. For safety and a greater ability to control dust, most chimneys today are cleaned from the bottom up, from the inside to the outside. If the shaft is flexible enough to be conveniently transported in a coil through a customer's living area, it is not rigid enough to be forced up the average chimney flue. Additionally, it has been found that when flexible shafts are used to spin the brush head, the brush will "ride up" one side of a lengthy vertical shaft or chimney flue and will not stay centered as to evenly clean all sides of the flue.

If the shaft is constructed with enough rigidity as to allow it to be pushed upward from the bottom opening to the top opening of the flue it cannot be conveniently transported and must also be straightened out before it can be used. This requires two operators and is impractical. For example, if the shaft is of sufficient length to clean the average two-story chimney from a basement access port, it must generally be at least 32 feet in length. This requires a corresponding 32 feet of linear space in the house to allow the shaft to be straightened out or snaked about in a relatively straight manner. When that is done, the drill or powering device is 32 feet away from brush or cleaning head, which requires constant communication between the drill operator and the brush operator to ensure safe operation and avoid allowing the soot covered shaft from to come in contact with the interior finishes and furnishings.

It can be seen from the above that a need exists for improved devices and methods for cleaning a chimney. The present invention addresses that need.

SUMMARY OF THE INVENTION

In one aspect of the present invention there is provided a device for cleaning a chimney. In one embodiment the inventive device comprises:

a) a rod assembly effective for pushing a cleaning head assembly, a remote viewing apparatus, and a stabilizing/positioning assembly up a chimney, said rod assembly defining a longitudinal axis;

b) a cleaning head assembly mounted directly or indirectly to said rod assembly, wherein said cleaning head assembly comprises: i) a rotatable hub, ii) two or more flexible cleaning members extending from the hub, and iii) two or more fan blade members extending from the hub;

c) a remote viewing apparatus mounted directly or indirectly to said rod assembly and comprising a camera which is continuously rotatable around the longitudinal axis to allow an uninterrupted 360° scan of the adjacent chimney interior at least five times every minute while the rotatable head is rotating.

d) a stabilizing/positioning assembly mounted directly or indirectly to said rod assembly and effective to position the center the said hub a pre-selected stabilizing/positioning distance from an interior wall of a chimney while the rotatable hub rotates in that chimney;

e) a motor effective for rotating said rotatable head at a speed of at least 400 rpm; and f) a cable assembly comprising a cable and a casing surrounding the cable, wherein said cable has a first end connected to said rotatable hub and a second end connected to said motor, and wherein the casing is sized and adapted to allow the cable to rotate in the casing without rotating the casing.

In one embodiment of the invention the two or more flexible cleaning members extending from the hub comprise straps or bristles with a length one to three inches greater than the stabilizing/positioning distance defined by the stabilizing assembly.

In one embodiment of the invention the fan blade members extending from the hub comprise flexible blades or straps having a length that is two to six inches less than the stabilizing/positioning distance defined by the stabilizing assembly.

In one embodiment of the invention the device includes lights to illuminate the interior space of a chimney.

In one embodiment of the invention the motor is a variable speed motor that is controlled by a foot switch to allow an individual chimney sweep to operate the cable, the rod, and the motor speed simultaneously.

DESCRIPTION OF THE PREFERRED EMBODIMENTS

Figure 1:
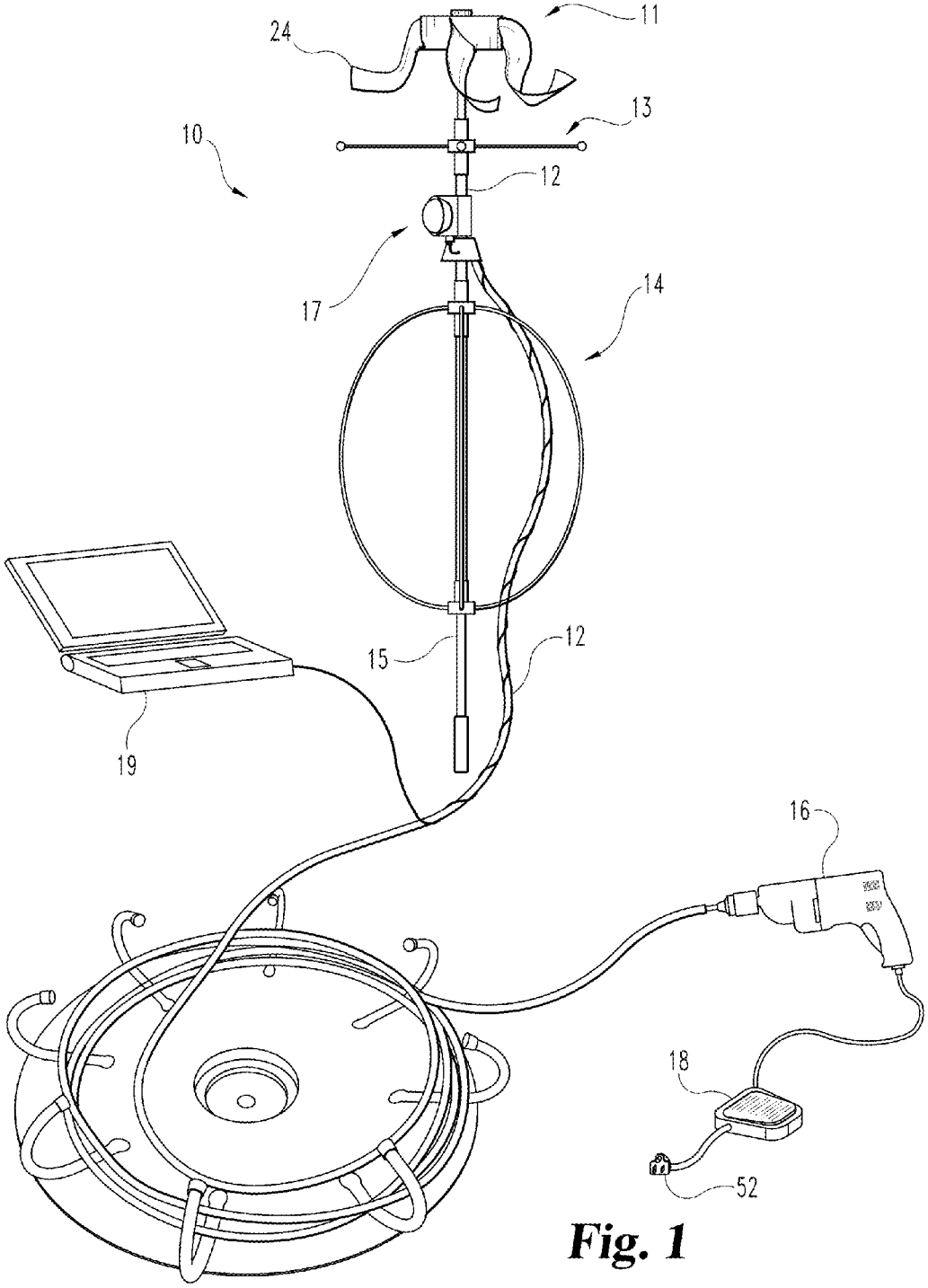
FIG. 1 shows one embodiment of the device of the present invention.

For the purposes of promoting an understanding of the principles of the invention, reference will now be made to certain embodiments and specific language will be used to describe the same. It will nevertheless be understood that no limitation of the scope of the invention is thereby intended. Instead, the claims of the application are intended to cover all alterations and further modifications in the illustrated invention, and such further applications of the principles of the invention disclosed herein, as would normally occur to one skilled in the art to which the invention relates.

One aspect of the present invention provides a device for cleaning and remotely inspecting a chimney. The device includes a cleaning head that preferably comprises a hub with one or more cleaning arms attached thereto. A cable assembly is attached to the cleaning head. The cable assembly includes a flexible cable in a flexible casing, with the casing being sized and adapted to allow the cable to spin freely within the casing. The flexible cable is turned by a motor, which may be a variable speed motor and which may use a foot pedal to control the speed. One or more rigid or semi-rigid rods are directly or indirectly attachable to the cleaning head to allow the cleaning head to be pushed up a tall chimney from below. One or more stabilizer/positioning assemblies may be directly or indirectly connected to the cleaning head assembly to allow the position and/or orientation of the cleaning head to be controlled and maintained.

Optional add-ons include a camera assembly to allow the user to remotely inspect the chimney interior before or after cleaning. A vacuum to remove dust and debris may also be included, as may an air knife to facilitate cleaning the chimney.

The Cleaning Head.

The cleaning head preferably comprises a hub and two or more cleaning arms extending from the hub. The cleaning arms may be conventional chimney sweeping brushes, or they may be brushes of a new design.

In one embodiment the brush arms are made of ballistic nylon fabric that is cut into straps with dimensions of about 12 inches long, about 1.5 inches wide, and about ⅛ inch thick. When the brush arms have that width and thickness they are less likely to become caught in gaps in the chimney wall.

In another embodiment the cleaning arms are made of metal, such as woven or chain metal cleaning arms. Alternatively, the cleaning arms may be plastic or plastic coated steel cable.

In one embodiment the cleaning arms are substantially solid arms that are angled with respect to the axis of rotation so that the cleaning arms additionally act as fan blades to efficiently move air up the chimney when they spin. There may be two, three, four, or more cleaning arms, and each arm may have a length, width, thickness, twist, shape, angle, etc. that is adapted to efficiently move air while simultaneously efficiently cleaning the chimney walls.

The cleaning head hub may include slots for receiving cleaning arms so as to allow a used or damaged arm to be replaced easily. The slots may be angled to facilitate the cleaning arms' acting as fan blades to move air.

In one embodiment the cleaning arms are made of a webbing material that comprises one or more members selected from the group consisting of polypropylene, nylon, copper, stainless steel, Kevlar, and ultra abrasion resistant nylon core material. The cleaning arms may angled at an angle of between about 20° and 60°, more preferably between about 25° and 45°, and most preferably about 30°.

In some embodiments the cleaning assembly includes both cleaning arm members and separate fan blade members. The cleaning arms are adapted to contact and clean the inside of a chimney when the cleaning head hub rotates. The fan blade members preferably have a length that is shorter than the length of the cleaning arms so that the fan blades do not contact the inside wall of a chimney when the hub rotates and the cleaning head is positioned such that the cleaning arms contact and clean the inside of the chimney. In the preferred embodiments the fan blade members are at least two inches shorter than the length of the cleaning arm members, and are more preferably between about two inches and four inches shorter than the length of the cleaning arm members.

The fan blade members may be flexible straps such as the cleaning straps previously described, or they may be more rigid fan blade members. In the most preferred embodiments the fan blades are collapsible to allow the device to be inserted through grates or other openings that are smaller than the interior chimney space.

In some embodiments there is one level of cleaning arms and a separate level of fan blade members attached to the same hub. Alternatively, separate hubs may be used, and a spacer may be provided between the two hubs. In some embodiments the fan blades may be provided as an element that is separate from the cleaning head, although the cleaning hub and the fan blade hub are preferably both driven by the same cable assembly. When provided, the fan blades are effective for creating a draft to force air and debris up the chimney and away from the inside of the house. This allows the device to operate cleaner than brush systems that simply allow debris to fall into the fireplace below.

The Cable Assembly.

The cable assembly provides the power to the cleaning head, and allows the operator to manipulate certain components of the system. The cable assembly preferably comprises a flexible cable and a casing surrounding the flexible cable. The flexible cable is effective for rotating the cleaning head in either direction at a speed of at least 400 rpm, and more preferably at least 600 rpm. The casing is sized and adapted to allow the cable to rotate in the casing without rotating the casing. The cable assembly has a cleaning head end and a motor end, with the cleaning head end being connected to the cleaning head, and the motor end being connected to the motor.

The flexible cable used in one preferred embodiment of the present invention is at least about 20 feet in length, and more preferably is between 20 and 50 feet long. The cable may be made from a low carbon steel flexible mandrel onto which are coiled multiple wires in multiple layers and directions. The cable assembly preferably has a diameter of between about 0.25 inches to about 0.375 inches, most preferably about 5/16 inches, to provide the appropriate balance of rigidity and flexibility. To enable the cable assembly to be easily transported and used in confined spaces, the cable is capable of rotating when coiled in a coil having a radius of 8 inches. The cable is capable of being rotated at speeds of up 2000 rpm, bi-directionally (designed to rotate in both clockwise and anti-clockwise directions), and can withstand a minimum of 40 in-lbs of torque during use.

The flexible cable is incased within a flexible protective casing, or sheath, made for the purpose of safety and protecting both the surrounding finishes and the flexible cable as it rotates within the casing.

The casing in some embodiments comprises mono-coiled, low carbon steel which is over-wound with a braided carbon steel wire, all of which is then covered with a flexible vinyl material.

The casing is preferably engineered to protect the cable from moisture, dust and dirt while retaining lubrication. It also works to prevent injury to the operator by eliminating contact with an unprotected rotating shaft at high speed. When the casing is provided with sufficient stiffness it may also prevent the shaft from helixing, or looping, during operation under torsional loads. Similarly, it may control the bending of the enclosed cable by guiding it into more natural and gradual bends while limiting how tight a bend radius it can achieve.

In one embodiment the two ends of the cable assembly each include a fitting that terminates with bore holes to enable coupling the cable assembly to connect easily to the driven end (motor) and to the working end (cleaning brushes/arms).

The cable assembly may be coiled in a reel or caddy to facilitate storing and moving the cable. In one embodiment the caddy is sized to hold the cable assembly in a coil with a diameter of between 12 and 24 inches. In this manner the cable assembly may be kept from the homeowner's floor or carpet, thus avoiding soiling the area around the chimney.

The caddy also facilitates feeding the cable out as the cleaning head is advanced up the chimney.

The Stabilizer/Positioning Assemblies.

One or more stabilizing and/or positioning assemblies are preferably included. In one embodiment the stabilizing/positioning assembly is effective to maintain a desired distance between the cleaning head and at least one interior wall of a chimney while the cleaning head rotates within the chimney. In other embodiments the stabilizing/positioning assembly is effective to maintain a proper orientation of the cleaning head while the cleaning head rotates.

The stabilizer/positioning assembly may comprise one or more rods extending from a single hub. The rod(s) may be adjustable as to the distance they extend from the hub to allow the assembly to position the hub a desired distance from, or a desired orientation with respect to, a chimney wall. In one embodiment a tee wrench is used to tighten or loosen a set screw to allow the rod(s) (also referred to as "whiskers") to be lengthened or shortened. A ball may be provided at the end of the rod to facilitate moving the rod along a chimney wall without having the rod catch in a crack or crevice of the chimney wall.

The stabilizer/positioning assembly may also comprise one or more rods bending between and connected to two hubs. The bent rods form a bow that extends outward to allow the assembly to position the hub at a desired distance from, or a desired orientation with respect to, a chimney wall. The bent rods act like the ball in the previously described embodiment to facilitate moving the device along a chimney wall without having the assembly catch in a crack or crevice of the chimney wall. With the "bowed rod" embodiment the distance that the rods extend from the device may be altered by pushing the two hubs closer together or moving them farther apart.

In one embodiment a pair of hubs may be used to hold the ends of the rods, with the hub(s) being positioned by one or more shaft collars. When at least one of the collar(s) is moved toward or away from the opposing hub, the amount of bowing of the rods is increased or decreased. The hubs may be any size appropriate to properly hold and position the rods, with hubs having a width of about 2 inches and a length of about 2 inches being effective for embodiment preferred to date.

In some embodiments the single hub stabilizer/positioner (also called a horizontal stabilizer) may be used in conjunction with the two-hub stabilizer/positioned (also called a vertical stabilizer) to stabilize the cleaning head and properly position it for effective cleaning.

In some embodiments the stabilizer assembly(s) is/are provided on the semi-rigid rod assembly that is used to push the device up a chimney and to position the device for proper use. In other embodiments the stabilizer assembly(s) is/are provided on the cable assembly or is attached to the device in some other way.

In some embodiments the positioning/stabilizing assembly comprises a first hub and a plurality of stabilizing/positioning rod members, with the first hub being mounted to the rod assembly. At least one of the plurality of stabilizing/positioning rod members has a first end mounted to and extending from the first hub, a second end free from said first hub, and a portion free to directly engage the inside surface of a chimney wall. The positioning assembly is accordingly effective to maintain a desired distance between the cleaning head and at least one interior wall of a chimney while the cleaning head rotates within the chimney.

In some embodiments at least one of the plurality of stabilizing/positioning rod members has a first end mounted to and extending from said first hub and a second end free to directly engage the inside surface of a chimney wall.

In some embodiments the positioning assembly additionally comprises a pair of hubs. The first hub is mounted to the rigid or semi-rigid rod assembly at a first position and the second hub is mounted to said rigid or semi-rigid rod assembly at a second position. At least one of the plurality of stabilizing/positioning rod members has a first end mounted to and extending from the first hub and a second end mounted to and extending from the second hub, with the rod member forming an arc between the first hub and the second hub, with the convex portion of the arc providing an outer surface that is free to directly engage the inner surface of a chimney when the device is positioned in a chimney. Most preferably, at least one of the hubs is movable along the axis of the rod assembly to lengthen or shorten the distance between the two hubs. The arc of each rod is thereby adjustable upon movement of the first hub relative to the second hub.

The Motor.

A motor may be attached to one end of the cable to rotate the cleaning head by rotation of the cable. In one embodiment the motor is a variable speed ⅜ inch drill capable of operating at speeds between 1 rpm and 1200 rpm. The motor preferably allows the cable to be rotated at a speed of at least 400 rpm, and more preferably allows the cable to be rotated at a speed of at least 600 rpm. The motor preferably allows the cable to be rotated in either direction. The motor is mounted within the reeler and connects directly to the flexible shaft, by way of a right angle gear drive. Power to the drill motor is accomplished by using a slip ring, located at the center of the reeler. There are two types of supports for the reeler, one interior for the shaft to roll over, plus a second series of rollers to confine the shaft to the interior supports. These exterior rollers support the entire reeler and are positioned to prevent the shaft from escaping the interior supports. They are positioned at 45 degrees, 90 degree, 110 degrees and 270 degrees. The 110 degree exterior roller provides room for the camera and brushing head to enter the case. The exterior hole where the shaft exits and enters the case is situated to the right so the shaft will enter the box and uniformly layer on the reeler one layer at a time.

A potentiometer may be provided to allow an operator to control the speed of the motor without using his hands to hold the speeds. This allows the operator to use his hands to control the cable assembly and the rigid or semi-rigid rod that advances the device up the chimney.

The Camera.

A camera for remotely inspecting the chimney during the cleaning process is optionally included in the device. The camera may be connected to the casing of the cable assembly because the outside casing of the cable assembly does not spin as the cleaning head spins. The outside casing can be maneuvered by the operator though, allowing the operator to direct the camera at a desired area of the chimney interior. This allows the operator to see any defects in the flue during the cleaning operation.

The camera is preferably positioned near the cleaning brush, although it may be provided at a more distant location. In either case, the camera allows remote viewing (and recording) of the chimney while the chimney is being swept by the brush. This allows the operator to view the inside of the chimney while sweeping it, to identify any cracks or other defects that may require attention. A video display may be provided to facilitate observation by the chimney sweep.

In one embodiment the camera assembly includes a skirt or flange at the bottom of the assembly to receive the rigid or semi-rigid rods that are used to push the assembly up a chimney.

In the most preferred embodiments the remote viewing device (camera) is continuously rotatable around the longitudinal axis to allow an uninterrupted 360° scan of the adjacent chimney interior. The speed of rotation around the longitudinal axis may be between one time every minutes and thirty times every minute, with sweep times of between four times per minute and 15 times per minute being more preferred. More preferably the speed of rotation around the longitudinal axis allows the camera to sweep the inside of the chimney between five times per minute and 12 times per minute, with a rotation speed of about eight times per minute being most preferred. A rheostat may be provided to allow the operator to control the speed of rotation.

The remote viewing device may be a fixed focus camera or an adjustable focus camera. In some embodiments the camera has an automatic focus control. In the most preferred embodiments the camera can focus on the inside of the chimney wall when the camera is positioned six inches to 12 inches from the wall.

The remote viewing device is preferably capable of viewing the workspace regardless of whether the cleaning heads are spinning, and controls to allow viewing are provided. The controls allow the operator to view a desired section of the workspace at will, or allow the operator to select a continuous scan of the space. The controls allow the operator to stop the camera at any position to view a potential defect area, and allow the camera to reverse direction to view an area that was previously scanned. The rotation can be counterclockwise or clockwise and may be reversible at the discretion of the user.

In some embodiments the pitch of the camera may be adjusted so that an area above or below the camera may be viewed. The pitch adjustment may be controllable by the operator while the camera is operating.

The camera may have lights, such as a 360° ring of LED lights so image quality through rotation stays illuminated The Rigid or Semi-Rigid Rods.

One or more rigid or semi-rigid rods are preferably used to push the cleaning head and/or camera assembly, and the components attached thereto, up a chimney. The rods may also be used to position the cleaning head and/or camera assembly to facilitate cleaning and/or inspection of the chimney. In one embodiment the rigid or semi-rigid rods are conventional chimney sweep rods such as are used to manipulate mechanical chimney sweeping brushes. The individual rods are preferably between 2.5 feet and 6 feet in length, and a plurality of such rods may be connected together to provide a longer rod assembly as needed. The rod assembly is preferably long enough to push a cleaning head assembly, a remote viewing apparatus, and a stabilizing/positioning assembly up a chimney for a distance of at least about 15 feet, and more preferably for at least about 30 feet.

The rods may be attached to virtually any location of the assembly as long as they are effective for pushing the assembly up a chimney. Preferably, the rods are removably attached to the assembly, and are attached at a location effective for allowing the rods to best position the cleaning head and/or the camera for use as described herein.

As previously indicated, in some embodiments one or more stabilizer assemblies may be attached to the rigid/semi-rigid rod assembly to facilitate positioning the stabilizer assembly(s) in the chimney.

In one embodiment the rigid or semi-rigid rod assembly is adapted to include a camera assembly, one or more stabilizer assemblies, and the cleaning head assembly. In such embodiments the entire structure is rigid (or at least semi-rigid) from the rod handle end, through the stabilizer and/or camera assemblies, to the cleaning brush/arm end.

The Air Knife.

In another aspect of the present invention the device may include an air knife to dislodge debris from the interior of the chimney. The air knife may be provided in a manner to create a positive pressure over the brush and a negative air pressure below the brush. The negative air pressure created below the brush works with the natural draft or stack effect of the flue to remove dust and debris to the outside (through the flue opening on top of the chimney).

The Vacuum.

In another aspect of the present invention the device may include a vacuum for removing waste from the chimney after the waste is dislodged by the brush and/or the air knife.

Benefits of Certain Embodiments

The present invention provides advantages over prior art chimney cleaning devices. Only the inner core of the cable/rod spins, the outside jacket is remains static. The unique cleaning head (or "brush") design may be a loop, thus eliminating brush ends from getting caught in voids between flue tiles. Even if the loops break and were to get caught the device may be controlled with the potentiometer, the driving device (drill), and the motor may have a clutch that stops the shaft from spinning if the brush were to get caught.

The motor may be mounted to a fixed structure such as a cabinet that houses the cable assembly when the cable is wound on a reel. The operator need not hold the driving device (drill), and the motor may have a clutch that stops the motor if the brush were to get caught.

With certain embodiments of the present invention there is no need for a second, separate operation to video scan the flue.

Furthermore dust control is incorporated into the device with positive air flow from a small portable air compressor.

The loop design of one embodiment of the cleaning head/brush allows the brush to touch more of the surface area per rotation than prior art brushes. Prior art brushes only touch the surface area with the end of the plastic or steel cable. With the added benefit of the cameras, the operator can see the effectiveness of the cleaning operation while he is cleaning. This means no time is wasted stopping the cleaning operation to visually (or by use of a camera) inspect the effectiveness of the cleaning operation.

Flues often require a second or third cleaning operation to remove certain types of stubborn creosote deposits. With this device the operator knows the instant the chimney has reached a level of cleanliness that the flammable deposits no longer are a potential safety hazard. This device is also more effective because the use of stabilizers. The stabilizers hold the brush into the center of the flue opening. This ensures that all sides of the flue are cleaned simultaneously. The current state of the art utilizes no such centering device. Consequently the operator must whip the spinning rods around in a circular motion as it is spinning in hopes that the plastic or steel cable ends scrape and all side of the flue during the cleaning operation.

The motor may be controlled by a foot pedal and/or an on/off switch. The opposite end of the flexible shaft is attached to a brush that may be made of flexible steel or plastic bristles, braided cable, nylon strap, chain or any appropriate material for effectual cleaning. The brush materials may also be configured in a similar manner as the blades of a fan so as to create a positive draft above the brush as the brush spins. The "fan blade" brush head aids in the evacuation of the dislodged dust soot up and out the chimney flue to the outside.

The shaft is preferably flexible enough to easily be coiled for transport and may be incorporated on to a hose type reel. Attached to the outer casing of the flexible shaft are flexible plastic rods for the purpose of stabilization and keeping the brush centered in the flue as to ensure the brush is able to clean all sides of the flue.

One set of plastic rods are attached to a hub, they appear as adjustable whiskers with circular knobs on the end of each rod. These whiskers are generally positioned 2-3" below the brush, and are perpendicular to the flexible shaft. These whiskers can be adjusted to maintain the position of the brush either in the center for square/round flues or on either side, for cleaning rectangle/oval flues.

Another set of adjustable plastic rods appear as parallel to the flexible shaft are generally positioned a few inches below the "whisker" device. These four smaller plastic rods are generally attached at the top and bottom of an approximately 2' slightly larger plastic center rod by a hub positioned on the top and bottom. This second stabilization device is made adjustable as the bottom hub is slid up or down the center rod and locked into position at the desired adjustment. At the base of the bottom hub is an adaptor on to which standard chimney cleaning rods are attached for the purpose of pushing the flexible shaft up the flue. A video camera may also be incorporated into the device as to inspect for the cleanliness and condition of the flue.

REFERENCE TO THE DRAWINGS

Referring now to the drawings, FIG. 1 shows the device of the present invention according to one preferred embodiment. In that Figure device 10 includes cleaning head 11, cable assembly 12, stabilizers/positioners 13 and 14, rigid or semi-rigid rod assembly 15, motor 16, camera 17, and foot switch 18. Optional camera 17 and corresponding video display 19 are also shown.

Figure 2:
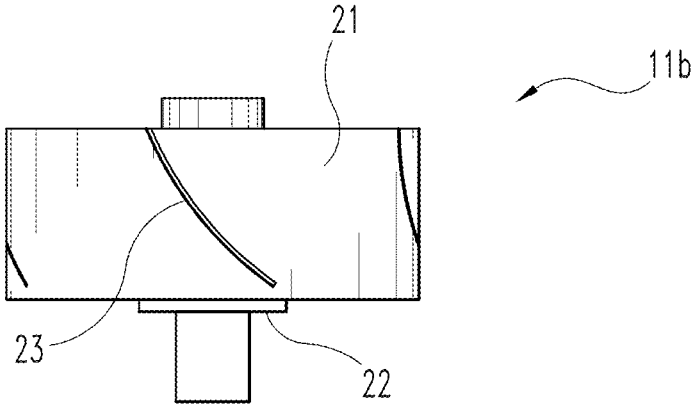
FIG. 2 shows one embodiment of a cleaning hub for use in the present invention without the cleaning arms.

FIG. 2 shows cleaning head hub 11*b* with the hub body 21, bushing 22 and slots 23 for receiving cleaning straps. Slots 23 are angled so that the cleaning straps will act as fan blades to move air along the axis of rotation of the hub to push air up and out of the chimney during cleaning.

Figure 3:
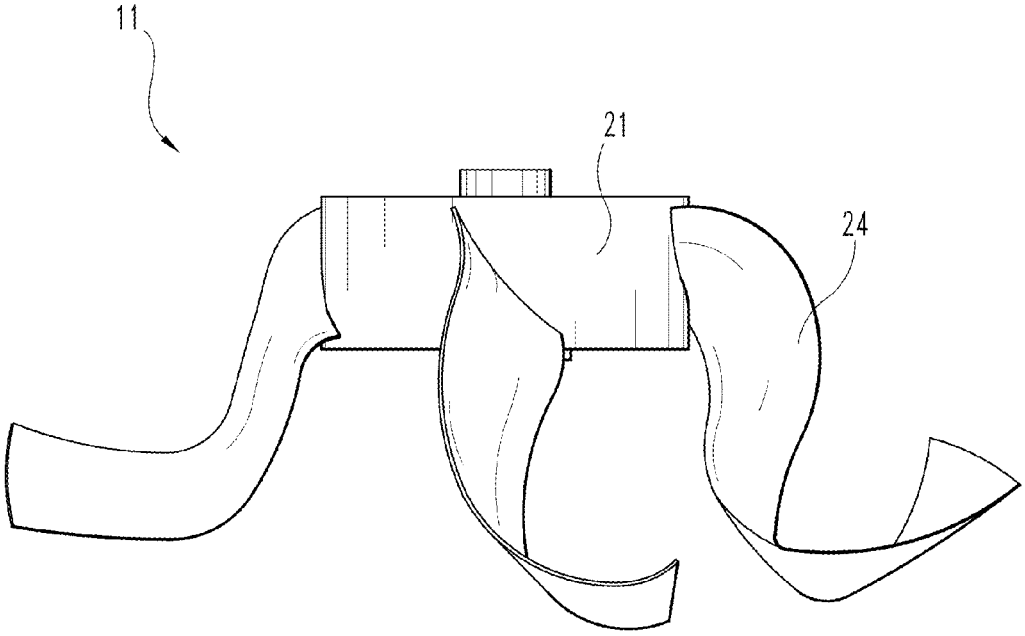
FIG. 3 shows one embodiment of a cleaning hub for use in the present invention with its associated cleaning arms.

FIG. 3 shows cleaning hub 11 with hub body 21 and cleaning arms 24. In the illustrated embodiment the cleaning arms are ballistic nylon that is flexible yet strong enough to clean creosote from a chimney wall. The flexible cleaning arms are angled to provide the fanned air movement previously described.

Figure 4:
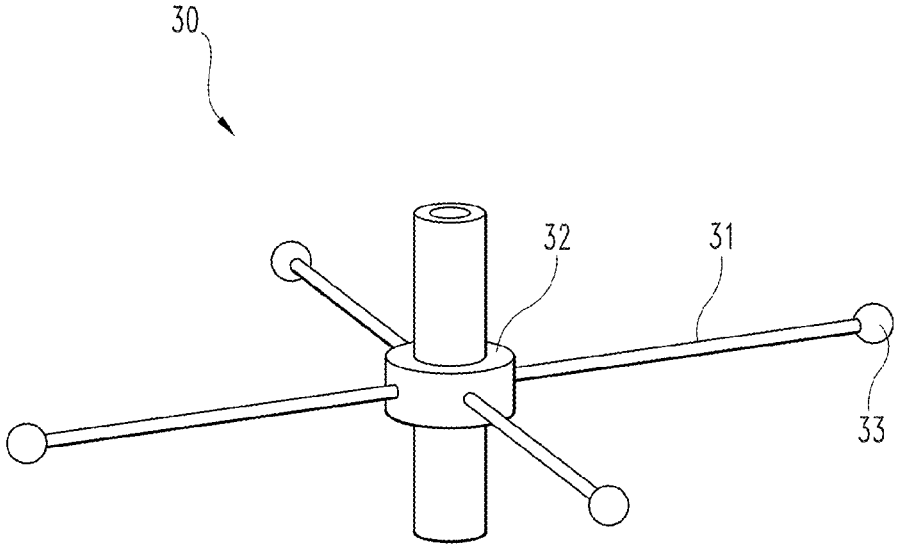
FIG. 4 shows one embodiment of a stabilizing assembly for use in the present invention.

FIG. 4 shows one embodiment of a stabilizer/positioner assembly 30, including hub 32 and rod arms 31. Balls 33 are provided at the ends of arms 31 to facilitate moving the device along a chimney wall. The embodiment illustrated in FIG. 4 may be referred to as a horizontal stabilizer since the arms extend primarily horizontally. This embodiment is particularly useful at positioning the device a desired distance from a chimney wall, and particularly for centering the device in a chimney.

Figure 5:
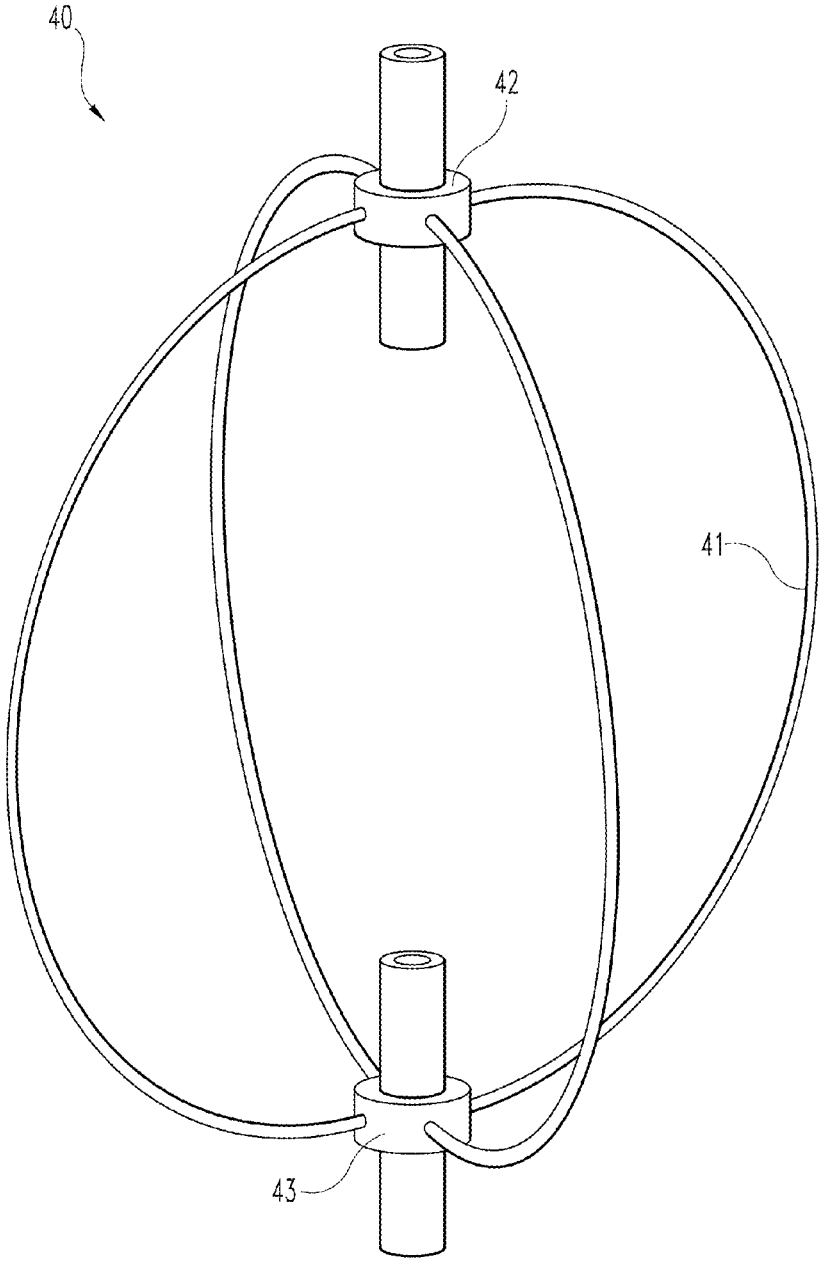
FIG. 5 shows one embodiment of a stabilizing assembly for use in the present invention.

FIG. 5 shows another embodiment of a stabilizer/positioner assembly 40, including hubs 42 and 43, and stabilizing rods 41. Stabilizing rods 41 are bent between and connected to hubs 42 and 43, which are movable along the axis of rod assembly 15 to provide more or less arc in the stabilizing rods. This embodiment is particularly useful at stabilizing the device, as well as for centering the device in a chimney.

Figure 6:
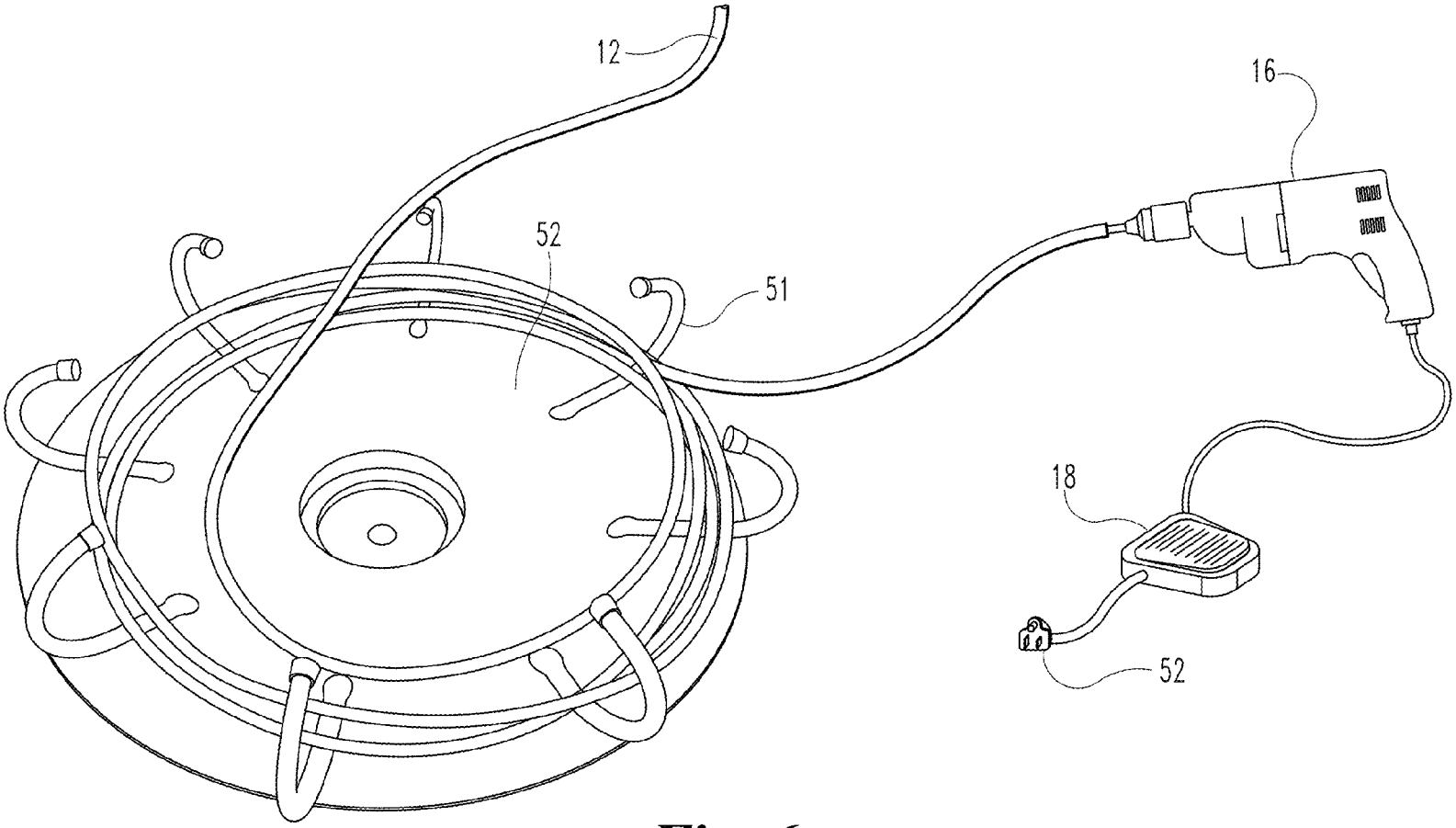
FIG. 6 shows one embodiment of a cable assembly for use in the present invention, and related hardware and components.

FIG. 6 shows components typically provided at the lower portion of the device. Cable assembly caddy 52 provides a way to coil the cable assembly 12 to facilitate storing and moving the device. This keeps the area around the home owner's chimney clean by preventing the soiled cable assembly from contacting the floor or carpet. Caddy arms 51 help keep the cable coiled in the caddy.

Figure 7:
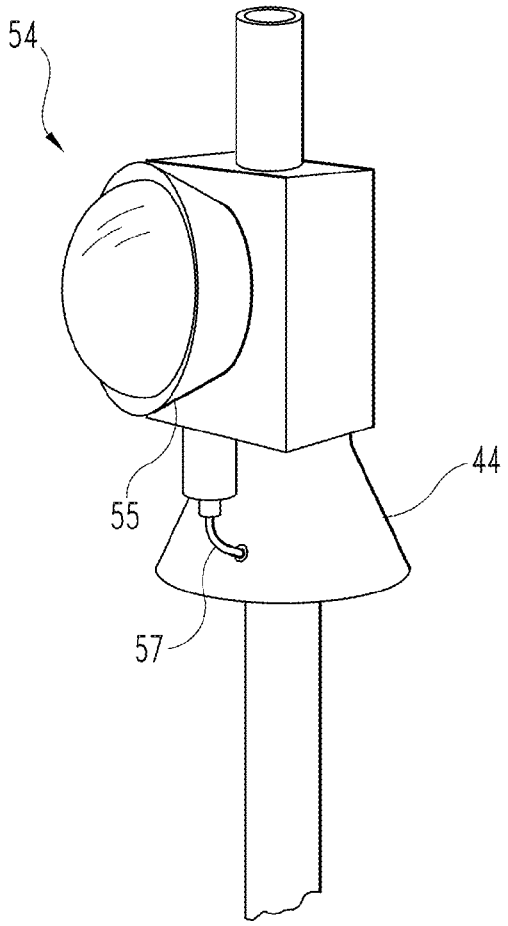
FIG. 7 shows one embodiment of a camera assembly for use in the device of the present invention.

The motor illustrated in FIG. 7 is a variable speed drill 16 that in the illustrated embodiment is connected to foot pedal 18 to allow the speed of the drill motor to be controlled by the operator without using his hands. An electrical plug 52 is typically provided, although cordless drill/motor embodiments are also contemplated.

As shown in FIG. 7, an optional camera assembly 54 may be provided on the device to allow remote monitoring of the chimney before, during and/or after the cleaning process. In the illustrated embodiment camera 55 is attached directly to rod assembly 15. An output cable 57 may be used to transmit the image to a remote display 19. A cable receiving portion 44 is illustrated at the bottom of camera assembly 54 to facilitate connection of cable assembly 12 to rigid rod assembly 15.

Figure 8:
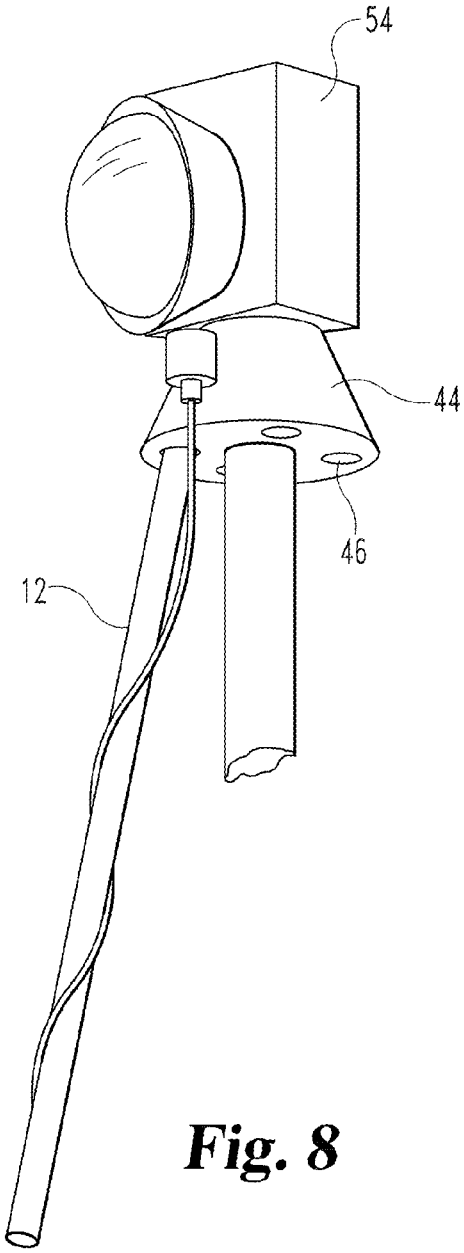
FIG. 8 shows one embodiment of the rod-connecting portion of a camera assembly for use in the device of the present invention.

FIG. 8 is another illustration of the lower portion of camera assembly 54, more clearly showing one embodiment of optional cable receiving portion 44 at the bottom of assembly 54.

Figure 9:
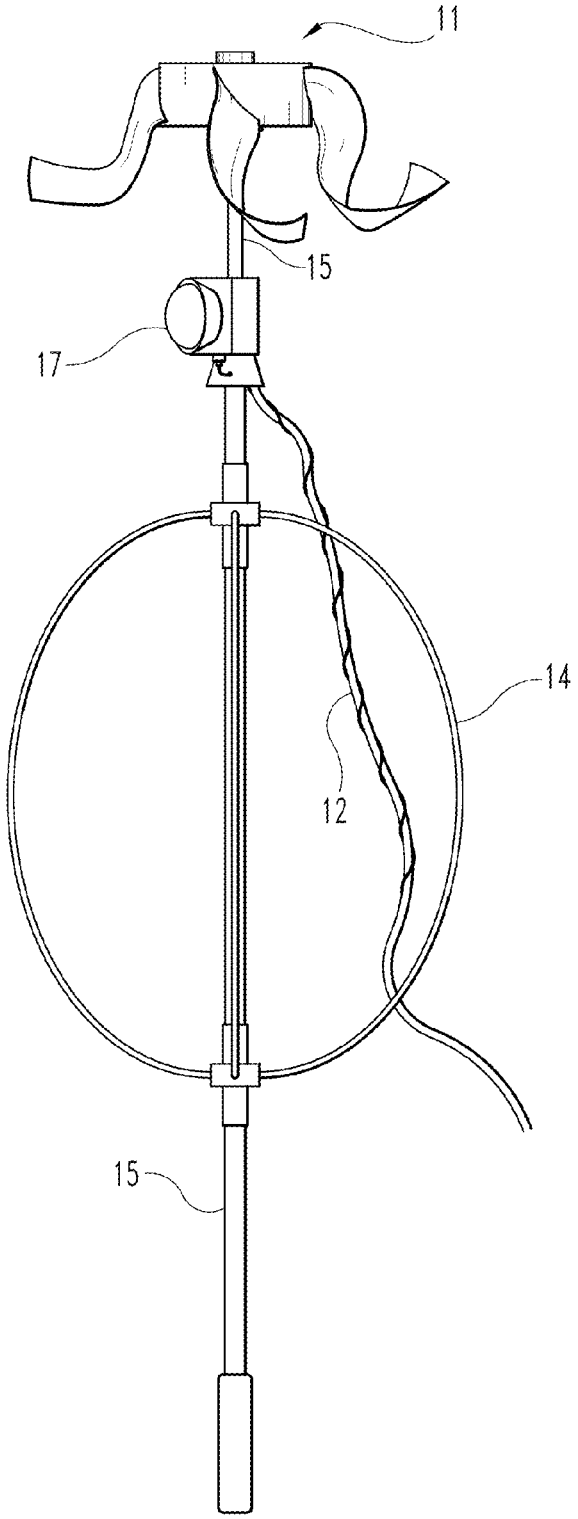
FIG. 9 shows one embodiment of the device of the present invention.
Figure 10:
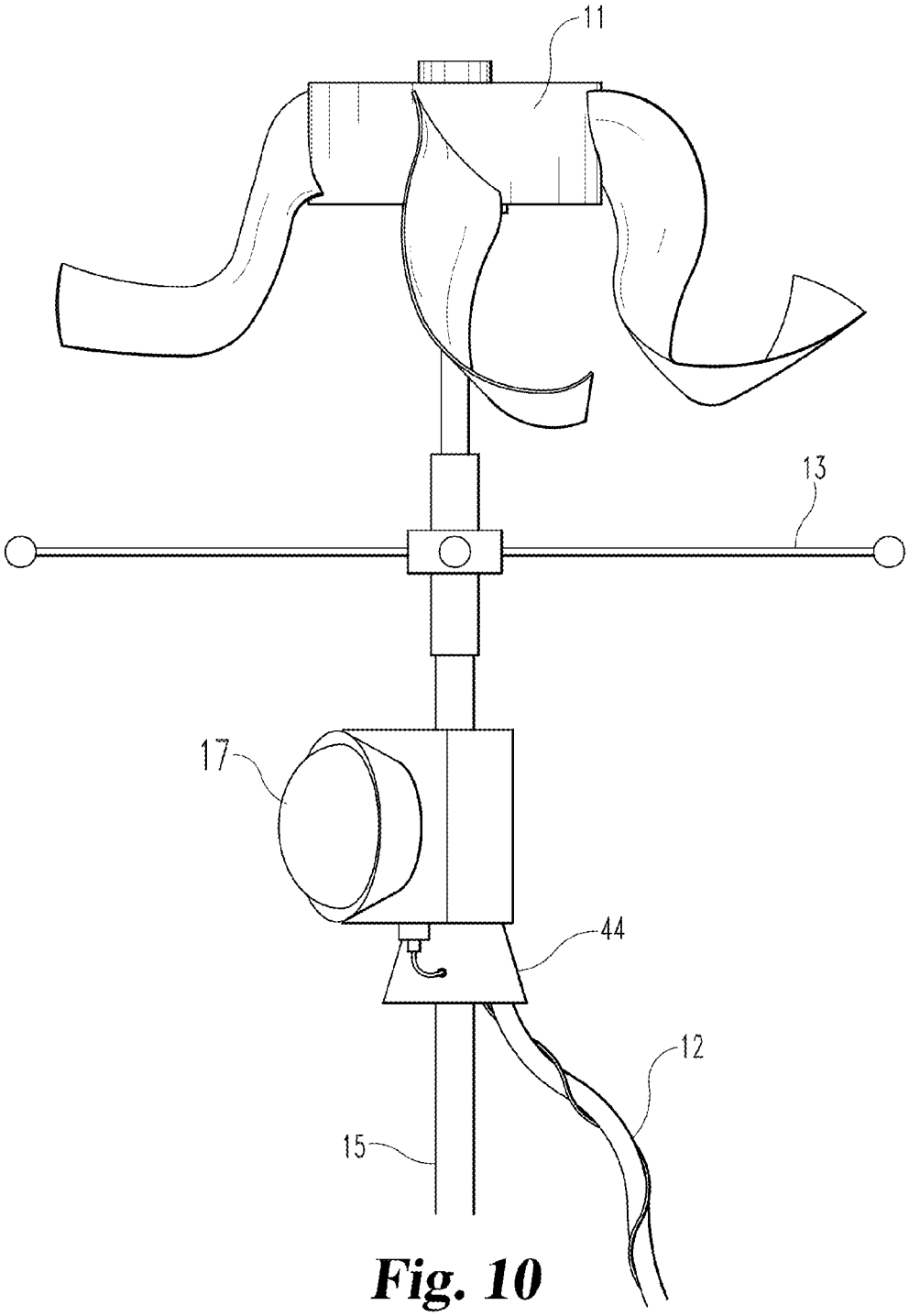
FIG. 10 shows another embodiment of the device of the present invention.

FIG. 9 shows an embodiment where only a vertical stabilizer is used. Similarly, FIG. 10 shows an embodiment where only a horizontal stabilizer is used.

Figure 11:
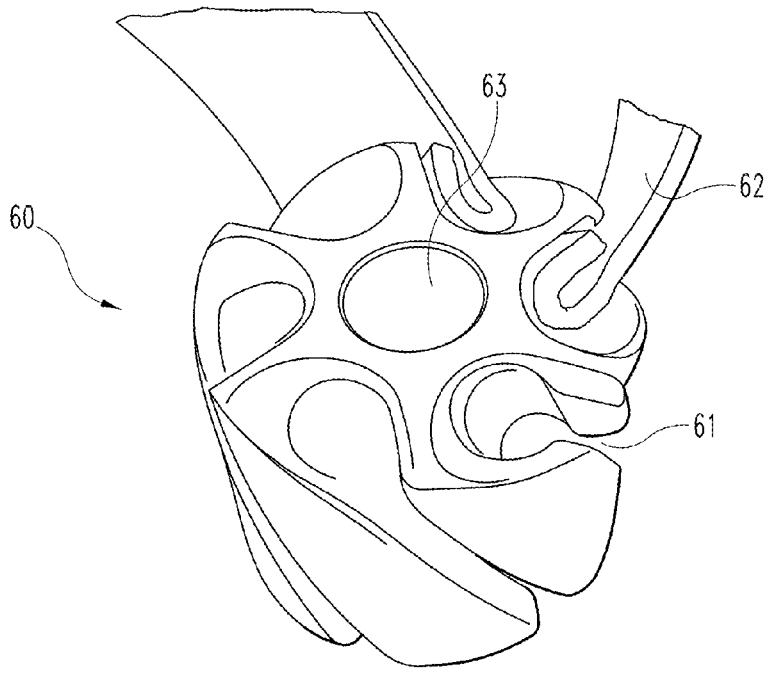
FIG. 11 shows one embodiment of a cleaning arm hub of the present invention with some cleaning arms in place.

FIG. 11 shows a cleaning arm hub of the present invention with some cleaning arms in place, according to one preferred embodiment. Cleaning arm hub 60 comprises cleaning arm hub groove 61 and cleaning arm 62. Cleaning arm hub center 63 facilitates attachment to the top of a cable assembly.

Figure 12:
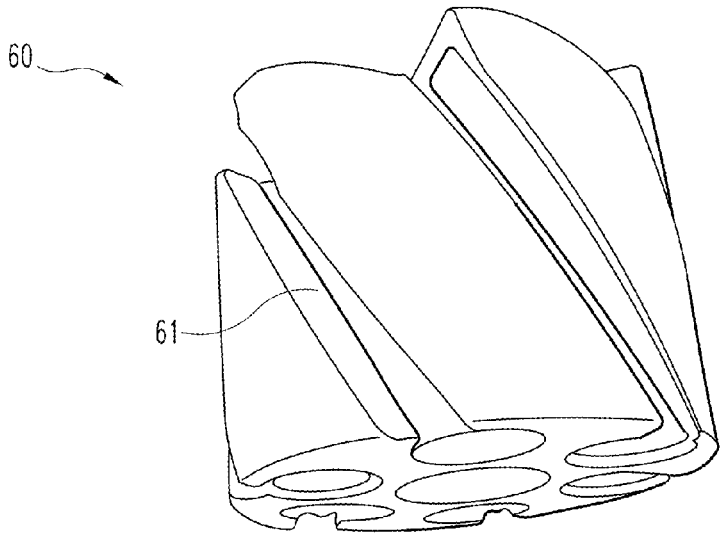
FIG. 12 shows another view of the cleaning arm hub of FIG. 11, without cleaning arms, according to one preferred embodiment.

FIG. 12 shows another view of the cleaning arm hub of FIG. 11. In this view, slot 61 is angled when compared to a cleaning arm that is positioned vertically with respect to the axis of rotation (i.e., parallel to the axis of rotation). The angle is preferably between 20 and 40 degrees, and most preferably about 30 degrees.

Figure 13:
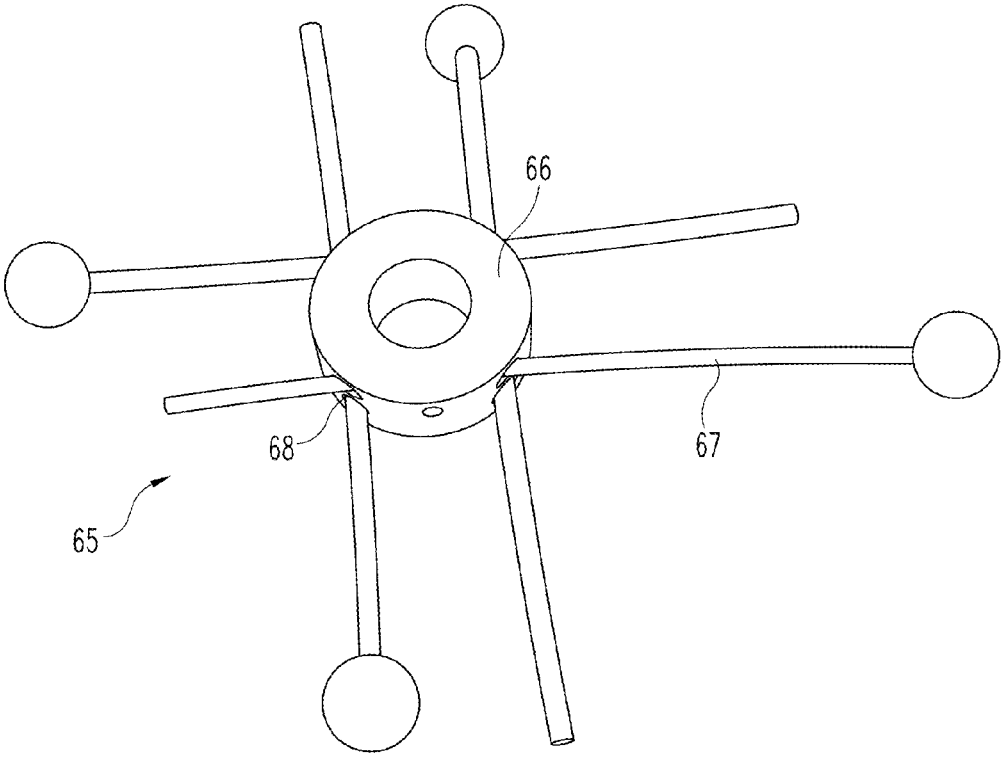
FIG. 13 shows one embodiment of a horizontal stabilizer assembly of the present invention.

FIG. 13 shows a horizontal stabilizer assembly of the present invention, according to one preferred embodiment. In that Figure horizontal stabilizer assembly 65 comprises horizontal stabilizer hub 66, and horizontal stabilizer whiskers 67. The horizontal stabilizer whiskers are received in whisker receiving aperture 68. A locking wrench 69 may be used to secure the assembly to a cable assembly.

Figure 14:
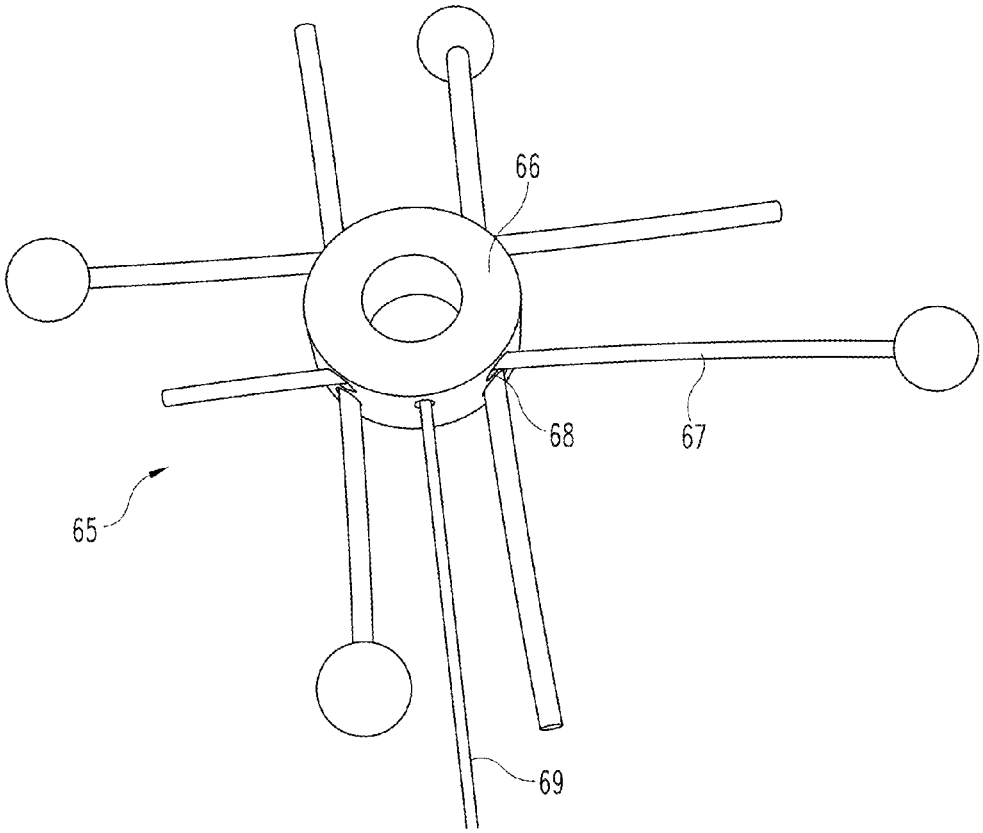
FIG. 14 shows another view of the horizontal stabilizer assembly of FIG. 13.

FIG. 14 shows another view of the stabilizer assembly of FIG. 13.

Figure 15:
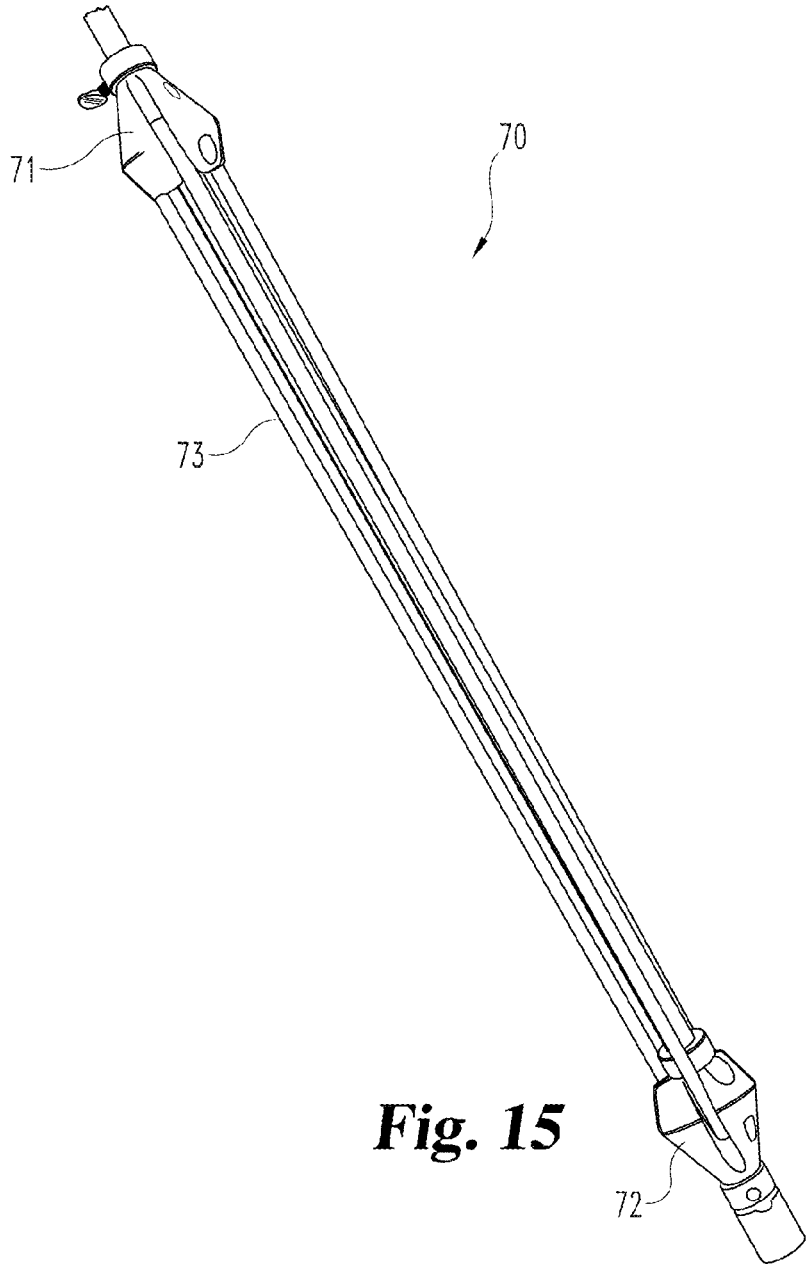
FIG. 15 shows one embodiment of a vertical stabilizer assembly of the present invention, according to one preferred embodiment, with the stabilizing arms in their "unbowed" position.
Figure 16:
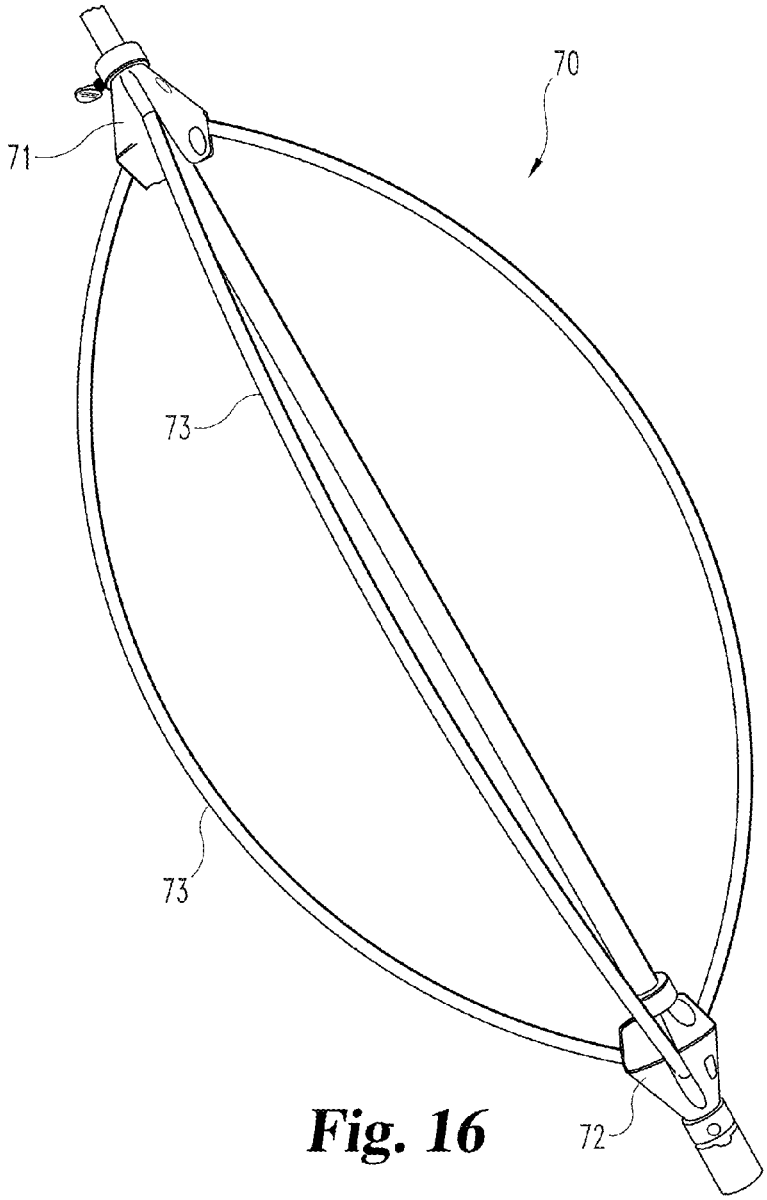
FIG. 16 shows the vertical stabilizer assembly of FIG. 15 with the stabilizing arms in their "bowed" position.

FIG. 15 shows a vertical stabilizer assembly of the present invention, according to one preferred embodiment, with the stabilizing arms in their "unbowed" position, and FIG. 16 shows the vertical stabilizer assembly of FIG. 15 with the stabilizing arms in their "bowed" position. In both Figures, vertical stabilizer assembly 70 includes movable vertical stabilizer hub 71, fixed vertical stabilizer hub 72, and stabilizer arms 73. A movable hub collar 74 may be used to position one or more of the stabilizer hubs, and particularly the movable stabilizer hub(s). A thumb screw 75 may be used to lock the hub collar in place.

Figure 17:
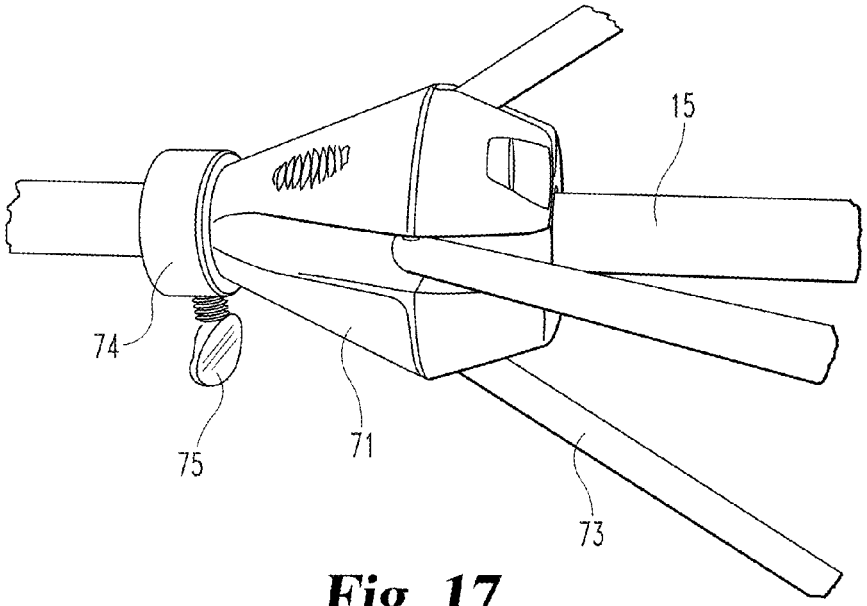
FIG. 17 shows the movable vertical stabilizer hub of the assembly of FIG. 15.
Figure 18:
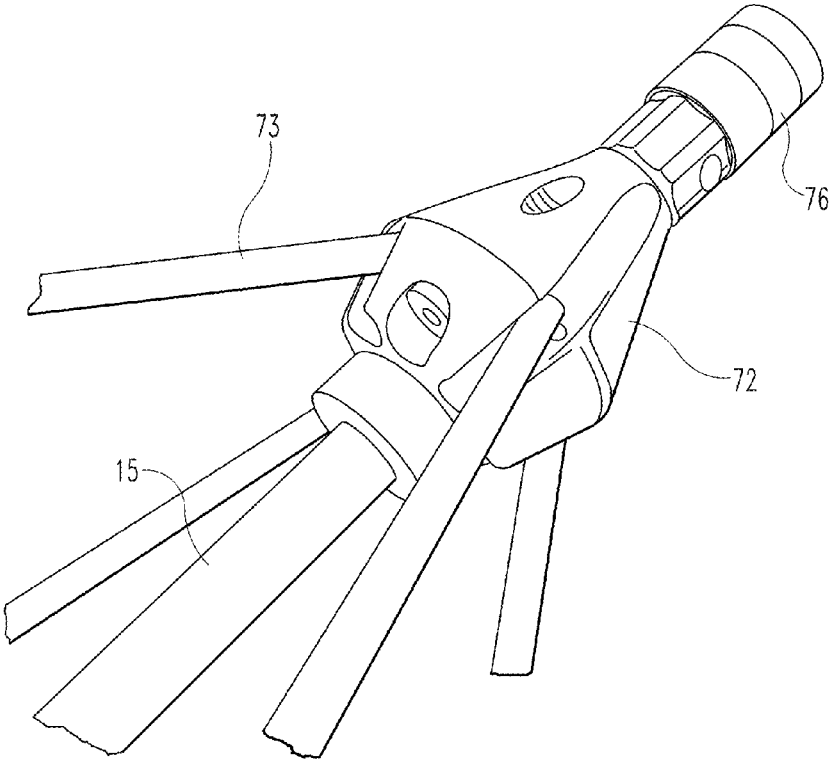
FIG. 18 shows the fixed vertical stabilizer hub of the assembly of FIG. 15.

FIG. 17 shows the movable vertical stabilizer hub of the assembly of FIG. 15, and FIG. 18 shows the fixed vertical stabilizer hub of the assembly of FIG. 15. Fixed collar 76 is illustrated in this Figure to position fixed vertical stabilizer hub 72.

Figure 19:
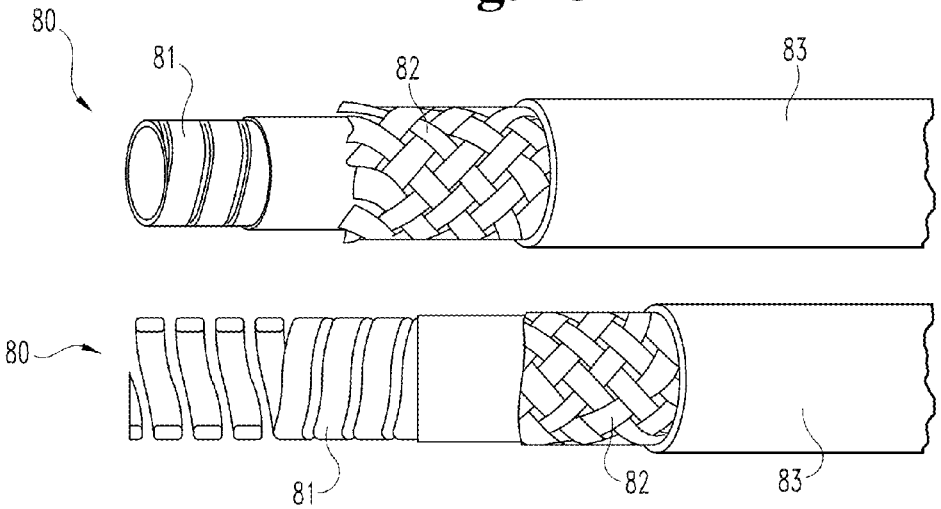
FIG. 19 shows one embodiment of the cable assembly of the present invention.

FIG. 19 shows a cable assembly 80 of the present invention, according to one preferred embodiment. In this Figure, cable 81 comprises mono-coiled, low carbon steel which is over-wound with a braided carbon steel wire 82, all of which is then covered with a flexible vinyl material 83.

Figure 20:
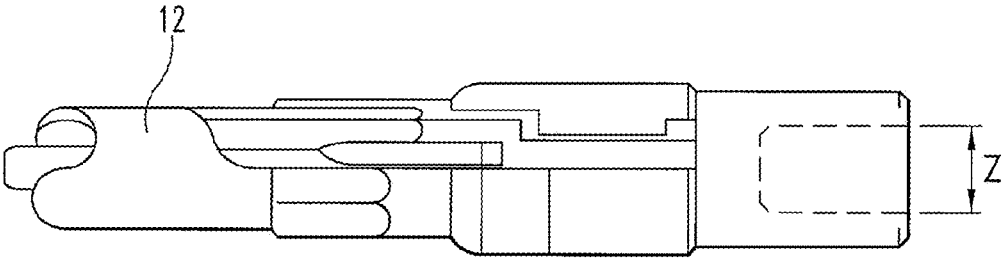
FIG. 20 shows one embodiment of the end(s) of the cable assembly of the present invention.

FIG. 20 shows one embodiment of the ends of the cable assembly. In this embodiment each end of the cable assembly 12 includes a fitting which is applied to the outside of the casing and connected to the flexible shaft. The fittings terminate with 0.375" bore holes to enable coupling the cable assembly to the driven end (motor) and to the working end (cleaning brushes/arms).

Figure 21:
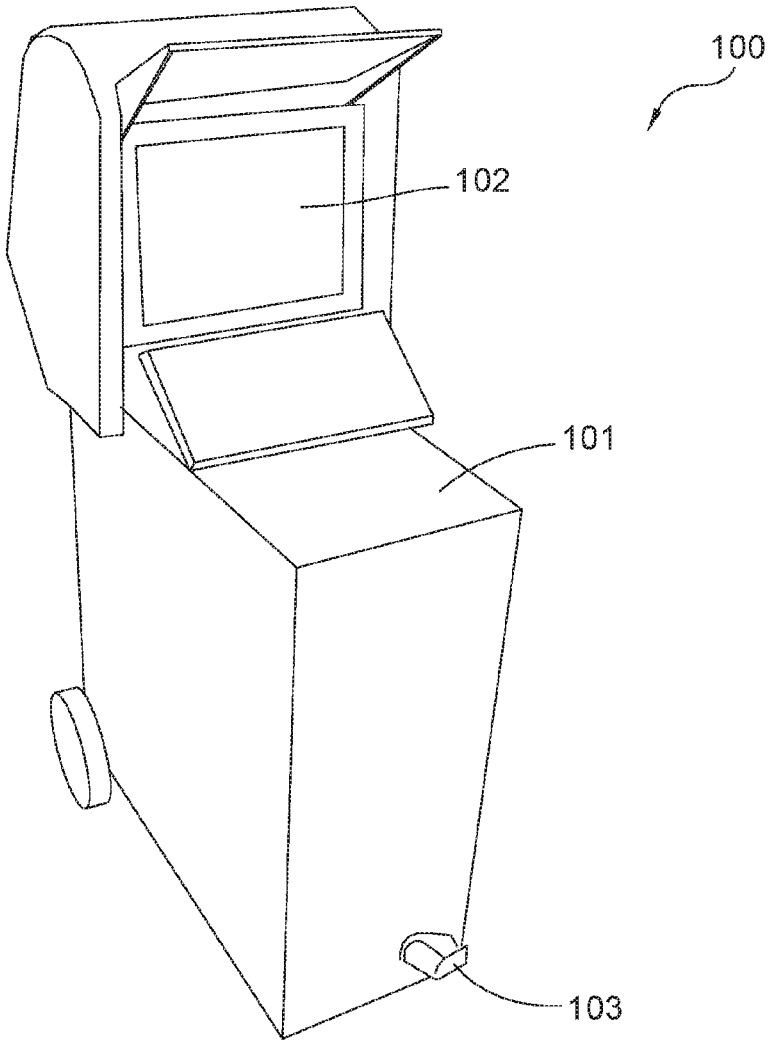
FIG. 21 shows the device of the present invention according to one preferred embodiment.

FIG. 21 shows the device of the present invention according to one preferred embodiment. A viewing screen 102 is provided above a cabinet 101 that houses the cable reel. The end 103 of the cable assembly without the cleaning head attached extends from an opening in the cabinet. The drill and speed control are located within the cabinet.

Figure 22:
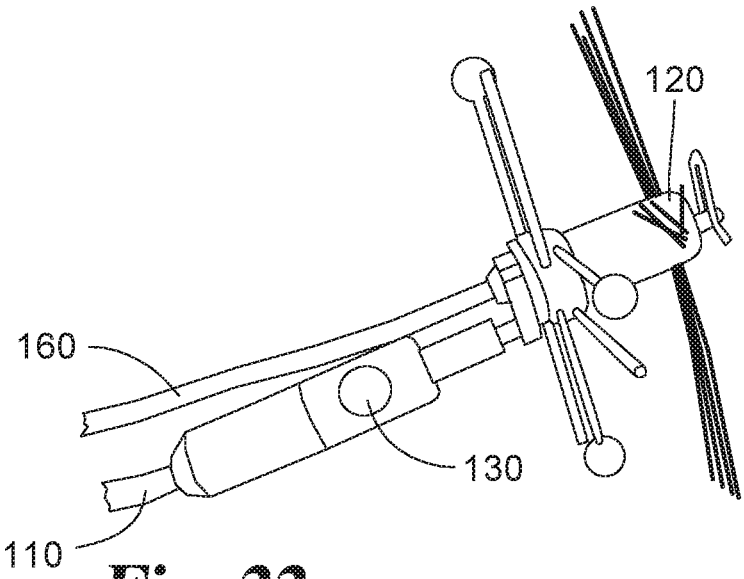
FIG. 22 shows a cleaning head assembly and remote viewing apparatus for use in the device of the present invention, according to one preferred embodiment.

FIG. 22 shows a cleaning head assembly 120 and remote viewing apparatus 130 for use in the device of the present invention, according to one preferred embodiment. Remote viewing apparatus 130 is attached to a rod assembly 110 so that the remote viewing apparatus can be pushed up a chimney. Cable assembly 160 drives cleaning head assembly 120.

Figure 23:
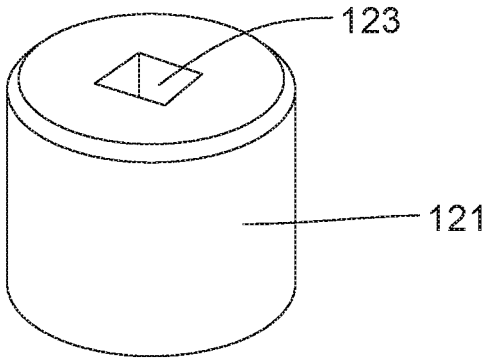
FIG. 23 shows a rotatable hub for use in a cleaning head assembly of the device of the present invention, according to one preferred embodiment.

FIG. 23 shows a rotatable hub 121 for use in a cleaning head assembly of the device of the present invention. Central opening 123 mounts to cable assembly 160 in a manner effective to allow the cable to rotate the hub. In one preferred embodiment hub 121 may have a square center made from aluminum. This allows other brushes to be placed on the flexible shaft by using a pin to lock to the shaft.

Figure 24:
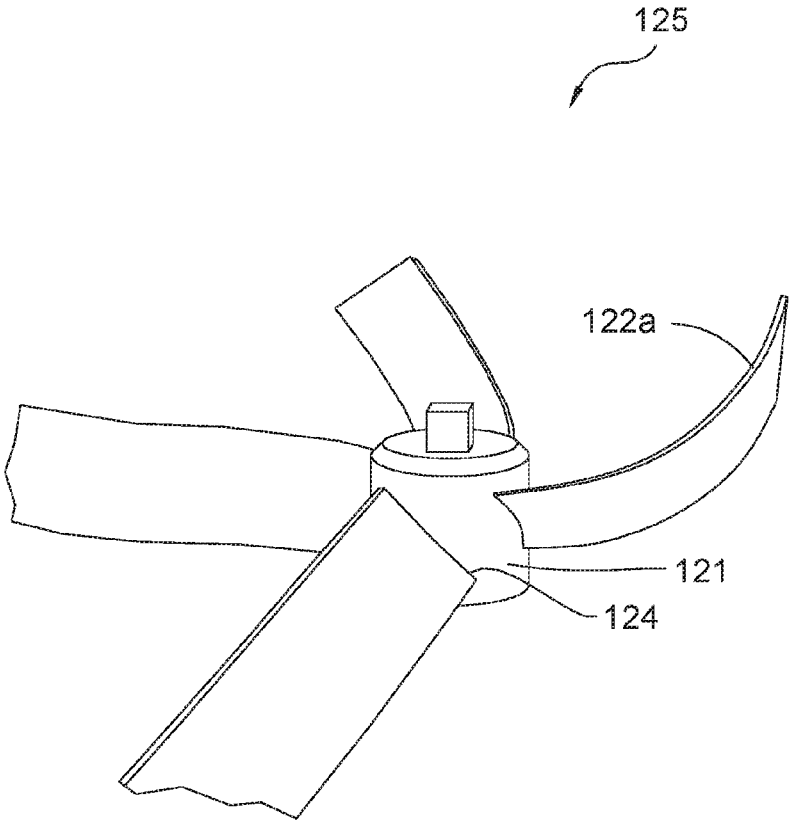
FIG. 24 shows a rotatable hub with straps that may be used as flexible cleaning members and/or as fan blades in a cleaning head assembly of the device of the present invention, according to one preferred embodiment.

FIG. 24 shows a rotatable hub with straps that may be used as flexible cleaning members and/or as fan blades in a cleaning head assembly of the device of the present invention, according to one preferred embodiment. Assembly 125 includes hub 121 having slots 124 for receiving flexible members 122. In the illustrated embodiment flexible members 122*a* are flexible straps that may function as cleaning members and/or fan blades. Flexible straps 122*a* may be made from polyurethane coated belting and may set at about 30 degrees (+/−) to provide upward lift.

Figure 25:
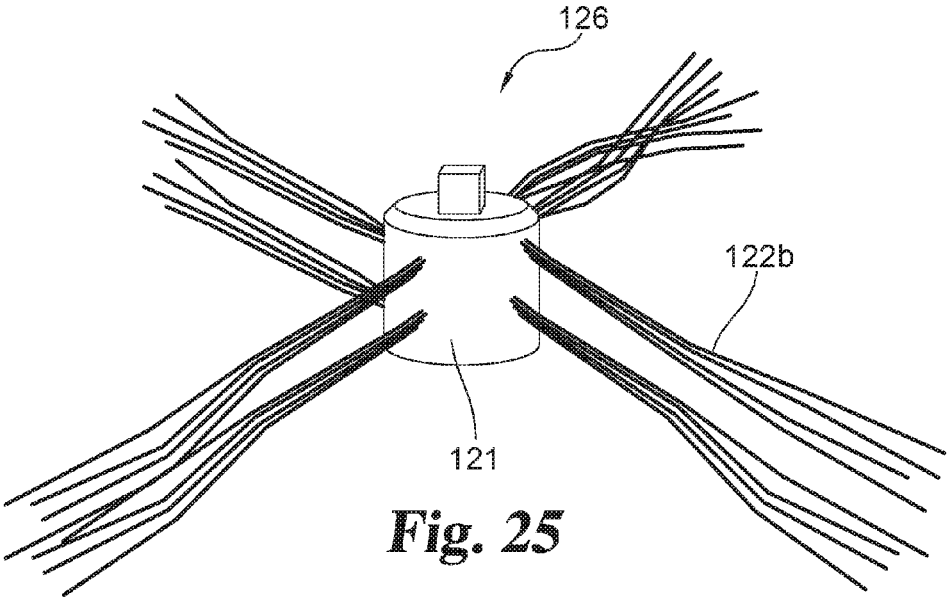
FIG. 25 shows a rotatable hub with flexible cleaning members for use in a cleaning head assembly of the device of the present invention, according to one preferred embodiment.

FIG. 25 shows a rotatable hub with flexible cleaning members for use in a cleaning head assembly of the device of the present invention. Assembly 126 includes hub 121 having slots 124 for receiving flexible members 122. In the illustrated embodiment flexible members 122*b* are flexible whiskers that may function as cleaning members. Flexible whiskers may be braided steel such as 1/16" steel encased in a plastic (e.g., polyethylene) casing.

Figure 26:
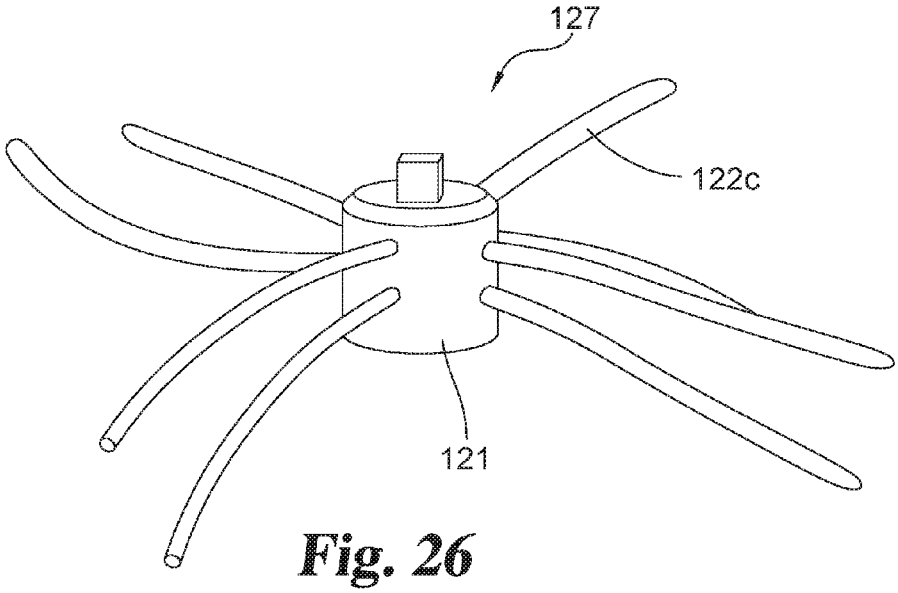
FIG. 26 shows a rotatable hub with flexible cleaning members for use in a cleaning head assembly of the device of the present invention, according to another embodiment.

FIG. 26 shows a rotatable hub with flexible cleaning members for use in a cleaning head assembly of the device of the present invention. Assembly 127 includes hub 121 having slots 124 for receiving flexible members 122. In the illustrated embodiment flexible members 122*c* are flexible tube members that may function as cleaning members.

Figure 27:
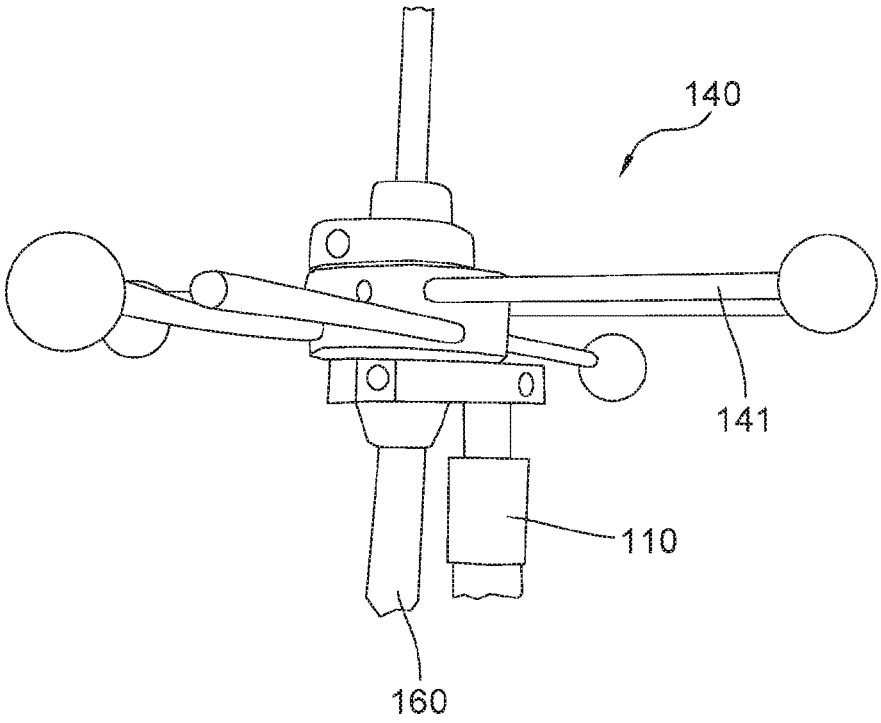
FIG. 27 shows a stabilizing/positioning assembly and associated connections for use the device of the present invention, according to one preferred embodiment.

FIG. 27 shows a stabilizing/positioning assembly and associated connections for use the device of the present invention, according to one preferred embodiment. Stabilizing/positioning assembly 140 includes arms 141 that extend for a distance effective to position the cleaning assembly hub a pre-selected stabilizing/positioning distance from an interior wall of a chimney while the rotatable hub rotates in the chimney. Cable assembly 160 and rod assembly 110 are also illustrated. Cable assembly 160 includes a rotatable shaft located in a casing. An adaptor to connect cable assembly 160 to rod assembly 110 is provided. The adapter receives the rod assembly and the camera mounted to the rod assembly. The positioning/stabilizing device can expand and contract to the interior of the flue by loosening set screws and sliding the whiskers in and out.

Figure 28:
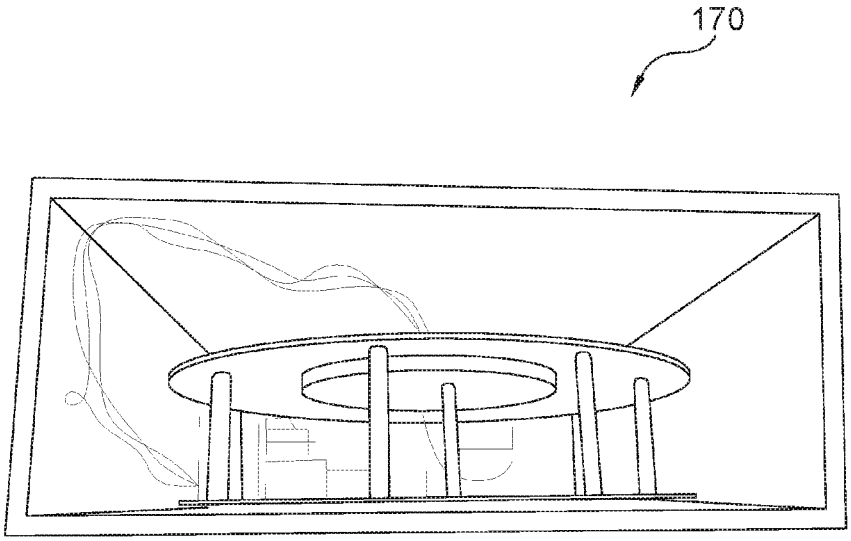
FIG. 28 shows a reeler for use in the device of the present invention, according to one preferred embodiment.

FIG. 28 shows a reeler 170 for use in the device of the present invention, according to one preferred embodiment. In the illustrated embodiment reeler 170 is located within the case and holds the shaft in place. The motor (drill) is located within the reeler with the speed and direction controls mounted to the case side. An electrical outlet is mounted for exterior connection. A slip ring is mounted to one side to provide power to the drill.

Figure 29:
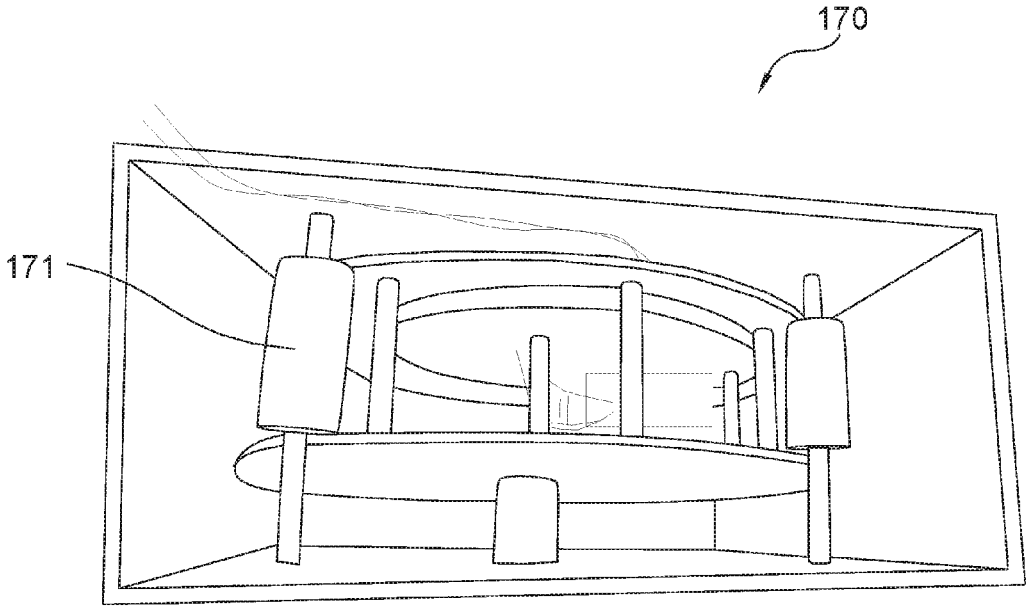
FIG. 29 is another view of a reeler for use in the device of the present invention, according to one preferred embodiment.

FIG. 29 is another view of a reeler for use in the device of the present invention, according to one preferred embodiment. Reeler 170 includes press wheels 171 that function to keep the shaft in control. The press wheel centers maintain the reeler width and the wheels keep the shaft in position. The press wheels may be positioned so that the camera and brush can enter the case while keeping the shaft in place all the time. The wheels maintain control over the shaft at all times.

Figure 30:
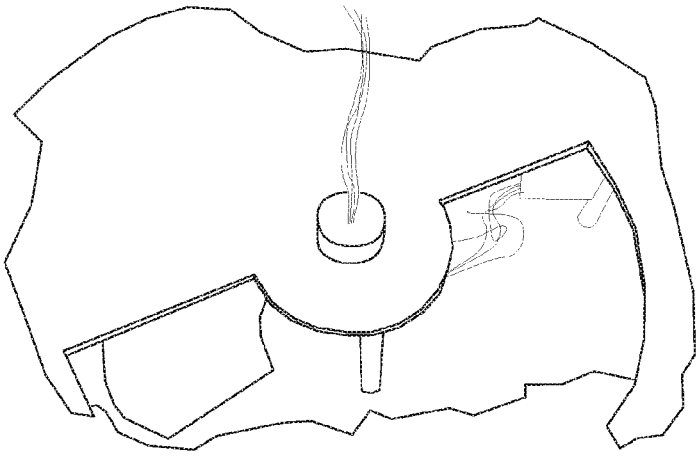
FIG. 30 shows a slip ring assembly leaving a reeler for use in the device of the present invention, according to one preferred embodiment.

FIG. 30 shows a slip ring assembly leaving a reeler for use in the device of the present invention, according to one preferred embodiment.

Figure 31:
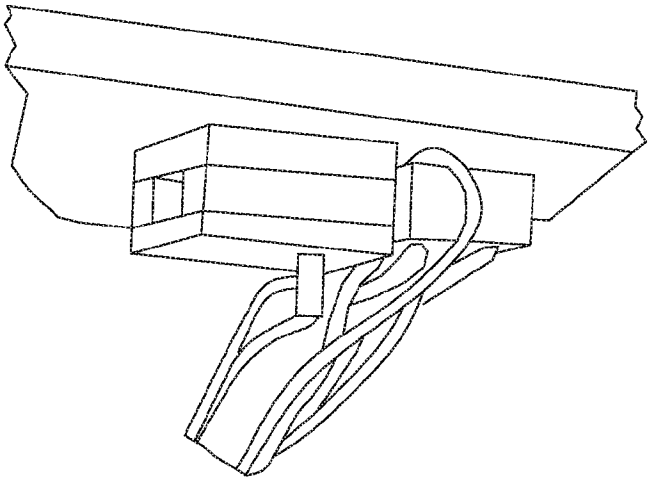
FIG. 31 shows electrical components, including a switch, for use the device of the present invention, according to one preferred embodiment.

FIG. 31 shows electrical components, including a switch, for use the device of the present invention, according to one preferred embodiment. While the switch may be located on the drill handle, it is preferably mounted to the case side as illustrated by the Figure. A knob with a cam may be provided to rotate and push the switch to increase or decrease the speed.

Figure 32:
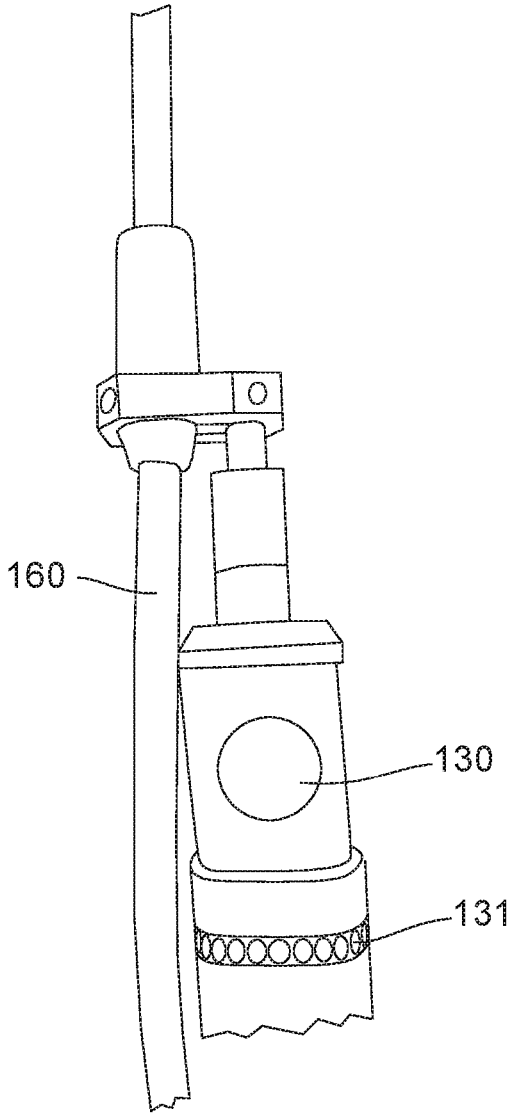
FIG. 32 shows a remote viewing apparatus for use in the device of the present invention, according to one preferred embodiment.

FIG. 32 shows a remote viewing apparatus 130 for use in the device of the present invention, according to one preferred embodiment. The camera is mounted to the shaft by way of a coupler. The camera itself is designed with a slip ring center so the camera can do 360 degree motion in either direction controlled by the control panel in the device controller. One or more lights, such as LED light ring 131, may be provided to illuminate the interior of the chimney when the camera is in use.

Figure 33:
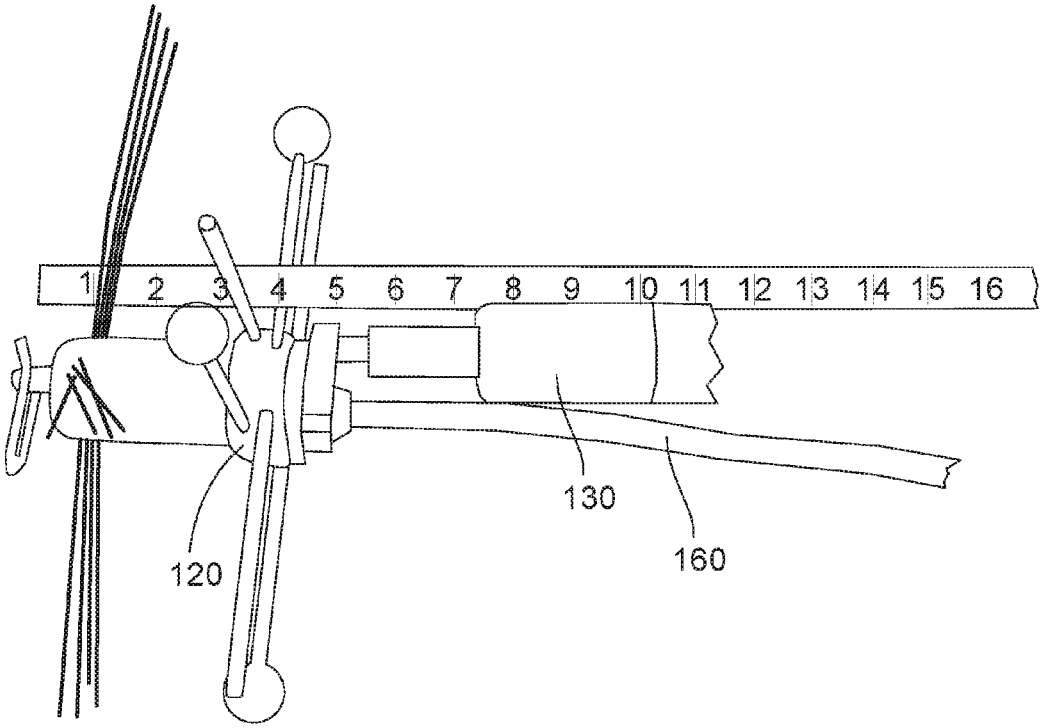
FIG. 33 shows a cleaning head assembly and remote viewing apparatus for use in the device of the present invention, according to one preferred embodiment.

FIG. 33 shows a cleaning head assembly and remote viewing apparatus for use in the device of the present invention, according to one preferred embodiment. The tape measure is aligned generally with the longitudinal axis of the device, and the cleaning head 120, remote viewing device 130, cable assembly 160 are shown. A connecting portion of rod assembly 110 is also indicated. The illustrated device has a length of about 12 inches to the rod connection, and a width of about 10 inches. Lengths of eight to 16 inches, and widths of eight to 16 inches, make the device particularly useful for use in the interior of most home chimneys.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In addition, it is to be appreciated that the present invention may comprise or consist essentially of any or all of the elements illustrated or described herein. For example, the present invention includes devices comprising each of the embodiments illustrated in FIGS. 1 through 33, and the present invention includes devices consisting essentially of any of the embodiments illustrated in FIGS. 1 through 33. Additionally, it is to be appreciated that the present invention may comprise or consist essentially of any or all of the elements illustrated or described in U.S. patent application Ser. No. 12/424,166 and/or in U.S. Provisional Patent Application Ser. No. 61/124,358 (both of which have been incorporated herein by reference), and/or may comprise or consist essentially of any or all of the elements illustrated or described herein in combination with any or all of the elements illustrated or described in U.S. patent application Ser. No. 12/424,166 and/or in U.S. Provisional Patent Application Ser. No. 61/124,358

The invention claimed is:

1. A device for cleaning a chimney, comprising:

a) a rod assembly effective for pushing a cleaning head assembly, a remote viewing apparatus, and a stabilizing/positioning assembly up a chimney, said rod assembly defining a longitudinal axis;

b) a cleaning head assembly mounted directly or indirectly to said rod assembly, wherein said cleaning head assembly comprises: i) a rotatable hub, ii) two or more flexible cleaning members extending from the hub, and iii) two or more fan blade members extending from the hub;

c) a remote viewing apparatus mounted directly or indirectly to said rod assembly and comprising a camera which is continuously rotatable around the longitudinal axis to allow an uninterrupted 360° scan of the adjacent chimney interior at least five times every minute while the rotatable head is rotating;

d) a stabilizing/positioning assembly mounted directly or indirectly to said rod assembly and effective to position the cleaning assembly hub a pre-selected stabilizing/positioning distance from an interior wall of a chimney while the hub rotates in the chimney, wherein said stabilizing/positioning assembly comprises a first movable stabilizer hub attached to the rod assembly at a first position, a second movable stabilizer hub attached to the rod assembly at a second position spaced apart from the first position, and a plurality of stabilizing arms extending from the first hub to the second hub, wherein each of said first movable stabilizer hub and said second movable stabilizer hub is movable along the longitudinal axis with respect to the other of said first movable stabilizer hub and said second movable stabilizer hub to adjust the distance along the longitudinal axis between the first movable stabilizer hub and said second movable stabilizer hub;

e) a motor effective for rotating said rotatable head at a speed of at least 400 rpm; and f) a cable assembly comprising a cable and a casing surrounding the cable, wherein said cable has a first end connected to said rotatable hub and a second end connected to said motor, and wherein the casing is sized and adapted to allow the cable to rotate in the casing without rotating the casing.

2. The device of claim 1 wherein the two or more flexible cleaning members extending from the hub comprise straps or bristles with a length one to three inches greater than the stabilizing/positioning distance defined by the stabilizing assembly.

3. The device of claim 1 wherein the fan blade members extending from the hub comprise flexible blades or straps having a length that is two to six inches less than the stabilizing/positioning distance defined by the stabilizing assembly.

4. The device of claim 1 wherein the device further includes lights to illuminate the interior space of a chimney.

5. The device of claim 1 wherein the motor is a variable speed motor that is controlled by a foot switch to allow an individual chimney sweep to operate the cable, the rod, and the motor speed simultaneously.

6. The device of claim 1, and further including a second positioning assembly effective to maintain the cleaning head at a desired orientation within a chimney while the cleaning head rotates.

7. The device of claim 1, and further including an air knife for dislodging debris when the device is used to sweep a chimney.

8. The device of claim 1, and further including a vacuum effective for removing waste dislodged by the device when the device is used to sweep a chimney.

9. The device of claim 1 wherein said cleaning arms comprise flexible strap members.

10. The device of claim 1 wherein said flexible strap members comprise ballistic nylon woven into straps having a length of at least eight inches, a width of at least one inch, and a thickness of at least ⅛ inch, said straps being effective for cleaning a chimney of creosote when being rotated at a speed of at least 400 rpm by the cleaning head hub.

11. The device of claim 1 wherein said flexible cable is at least 20 feet in length and comprises a low carbon steel flexible mandrel onto which are coiled multiple wires in multiple layers and directions.

* * * * *

UNITED STATES PATENT AND TRADEMARK OFFICE

CERTIFICATE OF CORRECTION

PATENT NO. : 9,494,318 B2
APPLICATION NO. : 14/102647
DATED : November 15, 2016
INVENTOR(S) : John E. Meredith It is certified that error appears in the above-identified patent and that said Letters Patent is hereby corrected as shown below:

On the Title Page

(71) Please change Applicant from "Merediths' Inc." to --John E. Meredith and Thomas J. Urban--.

Signed and Sealed this
Eighteenth Day of April, 2017

Michelle K. Lee

Michelle K. Lee
*Director of the United States Patent and Trademark Office*